US011019421B2

(12) United States Patent
Lee et al.

(10) Patent No.: US 11,019,421 B2
(45) Date of Patent: May 25, 2021

(54) METHOD FOR DETECTING WEARING OF ACOUSTIC DEVICE AND ACOUSTIC DEVICE SUPPORTING THE SAME

(71) Applicant: Samsung Electronics Co., Ltd., Suwon-si (KR)

(72) Inventors: Jeock Lee, Suwon-si (KR); Hwan Shim, Suwon-si (KR); Seonmi Kim, Suwon-si (KR); Hangil Moon, Suwon-si (KR); Kyoungho Bang, Suwon-si (KR); Byeongmin Lee, Suwon-si (KR); Juhee Chang, Suwon-si (KR); Seeyoun Kwon, Suwon-si (KR); Hochul Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/837,292

(22) Filed: Apr. 1, 2020

(65) Prior Publication Data

US 2020/0314526 A1 Oct. 1, 2020

(30) Foreign Application Priority Data

Apr. 1, 2019 (KR) ..... 10-2019-0037973

(51) Int. Cl.
*H04R 29/00* (2006.01)
*H04R 1/10* (2006.01)

(52) U.S. Cl.
CPC ..... *H04R 1/1041* (2013.01); *H04R 29/001* (2013.01); *H04R 29/004* (2013.01); *H04R 2460/15* (2013.01)

(58) Field of Classification Search
CPC ..... H04R 29/00
See application file for complete search history.

(56) References Cited

U.S. PATENT DOCUMENTS 7,406,179 B2 * 7/2008 Ryan ..... H04R 1/10 381/312
9,820,070 B2 11/2017 Takenouchi
9,838,812 B1 * 12/2017 Shetye ..... H04R 1/1041
(Continued)

FOREIGN PATENT DOCUMENTS

WO 2019/045394 A1 3/2019

OTHER PUBLICATIONS

International Search Report dated Jul. 29, 2020, issued in International Application No. PCT/KR2020/004479.

*Primary Examiner* — Olisa Anwah
(74) *Attorney, Agent, or Firm* — Jefferson IP Law, LLP

(57) ABSTRACT

An acoustic device that includes a housing, a nozzle portion, a speaker hole, a first microphone hole, a speaker, a first microphone, and a processor configured to output a first signal through the speaker, receive a second signal corresponding to the first signal through the first microphone, output a third signal through the speaker when a magnitude of a first frequency band component of the second signal is greater than a first value, receive a fourth signal corresponding to the third signal through the first microphone, and determine that the protruding end surface of the nozzle portion is blocked and the acoustic device is not worn in a user's ear when a magnitude of a second frequency band component of the fourth signal is greater than a second value.

20 Claims, 12 Drawing Sheets

(56) References Cited

U.S. PATENT DOCUMENTS

| | | | |
|---|---|---|---|
| 9,967,647 | B2 | 5/2018 | Kumar et al. |
| 10,091,597 | B2 | 10/2018 | Termeulen et al. |
| 2013/0114823 | A1 | 5/2013 | Kari et al. |
| 2014/0126759 | A1 | 5/2014 | Rasmussen et al. |
| 2017/0094396 | A1 | 3/2017 | Chandramohan et al. |
| 2018/0070166 | A1 | 3/2018 | Howell et al. |
| 2019/0110121 | A1* | 4/2019 | Sapozhnykov ..... H04R 1/1041 |

* cited by examiner

METHOD FOR DETECTING WEARING OF ACOUSTIC DEVICE AND ACOUSTIC DEVICE SUPPORTING THE SAME

CROSS-REFERENCE TO RELATED APPLICATION(S)

This application is based on and claims priority under 35 U.S.C. § 119(a) of a Korean patent application number 10-2019-0037973, filed on Apr. 1, 2019, in the Korean Intellectual Property Office, the disclosure of which is incorporated by reference herein in its entirety.

BACKGROUND

1. Field

The disclosure relates to a technique of detecting the wearing of an acoustic device.

2. Description of Related Art

An acoustic device such as a headset may enable a user to enjoy music or a video alone without disturbing others. The acoustic device may include a speaker for outputting a sound and a microphone for receiving the voice of a user. For example, the user wearing the acoustic device may listen to music or the sound of a video output through the speaker of the acoustic device, and may input voice using the microphone of the acoustic device.

The acoustic device may have an in-ear structure, which is inserted into the user's ear canal to emit a sound output through the speaker. When voice generated from the user's vocal cords is transferred to the ear canal through the oral cavity, the eardrum, and the like, the acoustic device collects sounds and, and converts the sounds into an electrical signal. The in-ear acoustic device may include a nozzle portion forming a sound movement path of an acoustic module such as a speaker or a microphone therein.

Simultaneously when the user wears the acoustic device in his/her ear, the acoustic device may be automatically paired with an external electronic device such as a smart phone through a communication method such as Bluetooth so as to receive data from the external electronic device. Accordingly, the acoustic device may support the function of detecting the wearing thereof. For example, the acoustic device may detect the wearing thereof by detecting the proximity and close contact thereof with to the user's ear via a proximity sensor.

However, in the manner of detecting the wearing of the acoustic device via the proximity sensor, the acoustic device may determine that the acoustic device is worn in the user's ear even if the user merely holds a portion of the acoustic device, in which the proximity sensor is disposed, by hand.

The above information is presented as background information only, and to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages, and to provide at least the advantages described below. Accordingly, an aspect of the disclosure is to provide a method of detecting the wearing of an acoustic device in which the state of the acoustic device is determined through a response characteristic of a signal using a speaker and a microphone disposed inside the acoustic device, and an acoustic device supporting the method.

Another aspect of the disclosure is to provide a method of detecting the wearing of an acoustic device, which performs a predetermined function depending on the states of a plurality of acoustic devices, and an acoustic device supporting the method.

Additional aspects will be set forth in part in the description which follows and, in part, will be apparent from the description, or may be learned by practice of the presented embodiments.

In accordance with an aspect of the disclosure, an acoustic device is provided. The acoustic device includes a housing, a nozzle portion protruding outwards from one surface of the housing, a speaker hole penetrating the housing from an inner surface of the housing to a protruding end surface of the nozzle portion, a first microphone hole penetrating the housing from the inner surface of the housing to the protruding end surface of the nozzle portion, a speaker disposed inside the housing and connected to the speaker hole, a first microphone disposed inside the housing and connected to the first microphone hole, and at least one processor disposed inside the housing and electrically connected to the speaker and the first microphone.

In accordance with another aspect of the disclosure, the at least one processor may be configured to output a first signal through the speaker, receive a second signal corresponding to the first signal through the first microphone, output a third signal through the speaker when a magnitude of a first frequency band component of the second signal is greater than a first value, receive a fourth signal corresponding to the third signal through the first microphone, and determine that the protruding end surface of the nozzle portion is blocked but the acoustic device is not worn in a user's ear when a magnitude of a second frequency band component of the fourth signal is greater than a second value.

In accordance with another aspect of the disclosure, a method of detecting wearing of an acoustic device is provided. The method includes outputting a first signal through a speaker of the acoustic device, receiving a second signal corresponding to the first signal through a first microphone of the acoustic device, outputting a third signal through the speaker when a magnitude of a first frequency band component of the second signal is greater than a first value, receiving a fourth signal corresponding to the third signal through the first microphone, and determining that a nozzle portion of the acoustic device is blocked and the acoustic device is not worn in a user's ear when a magnitude of a second frequency band component of the fourth signal is greater than a second value.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
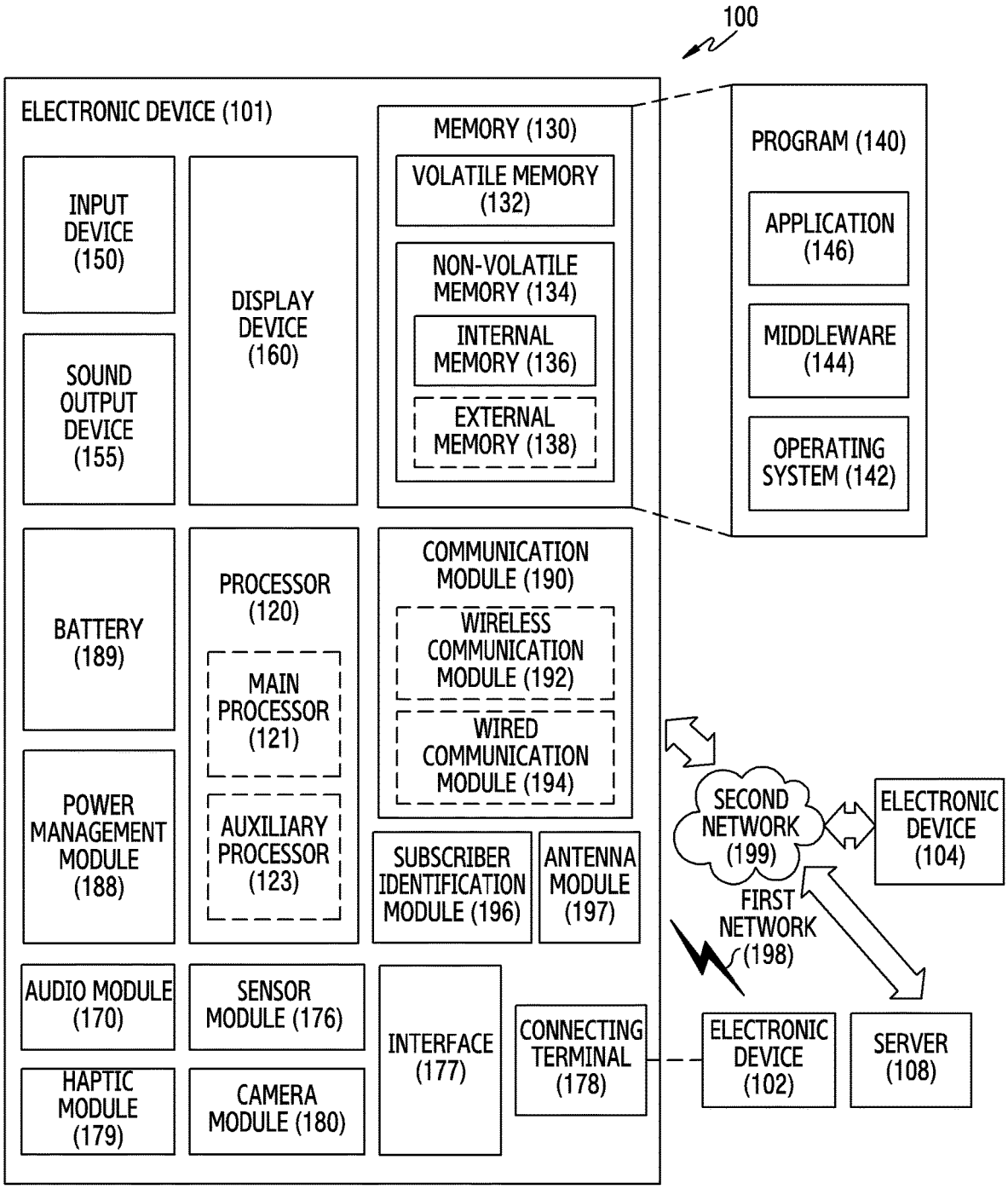
FIG. 1 illustrates a block diagram of an electronic device in a network environment according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, embodiments will be described with reference to the accompanying drawings. For convenience of description, the components illustrated in the drawings may be exaggerated or reduced in size, and the disclosure is not necessarily limited to the illustrated examples.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include at least one processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, and/or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to an embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 and/or the non-volatile memory 134. The non-volatile memory 134 may include an internal memory 136 and/or an external memory 138.

The program 140 may be stored in the memory 130 as software, and may include, for example, an operating system (OS) 142, middleware 144, and/or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture an image or moving images. According to an embodiment, the camera module 180 may include one or more lenses, image sensors, image signal processors, or flashes.

The power management module 188 may manage power supplied to the electronic device 101. According to an embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
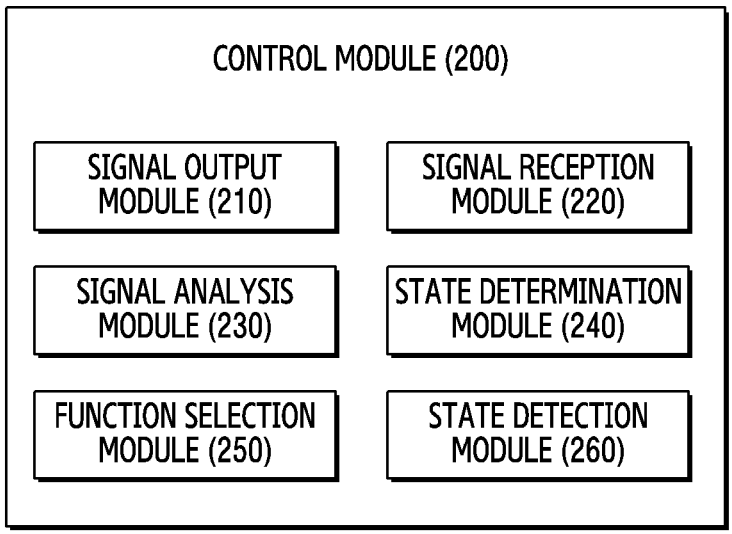
FIG. 2 illustrates a control module according to an embodiment of the disclosure.

FIG. 2 is a view illustrating a control module according to an embodiment of the disclosure.

Referring to FIG. 2, a control module 200 may be implemented with hardware and/or software components of the electronic device 101 described with reference to FIG. 1. For example, the control module 200 may be implemented in the form of the program 140 stored in the memory 130 of the electronic device 101. For example, the control module 200 may be implemented with instructions stored in the memory 130, and when the instructions are executed by the processor 120, the processor 120 may perform functions corresponding to the instructions. The control module 200 may perform a function, which is the same as or similar to that of the processor 120 or the processor 310 of FIG. 3.

Figure 3:
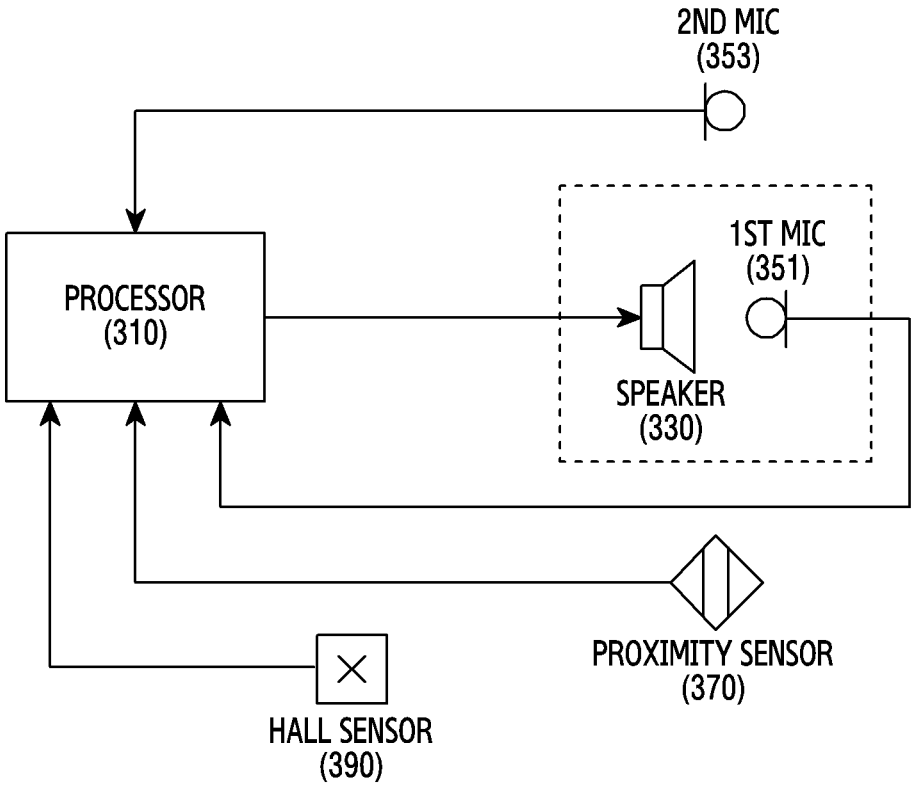
FIG. 3 illustrates an acoustic device according to an embodiment of the disclosure.

The control module 200 may perform functions related to signal output, signal reception, signal analysis, state determination, function selection, and state detection of an acoustic device (e.g., the electronic device 101 of FIG. 1 or the acoustic device in FIG. 3). Here, the acoustic device may include a nozzle portion that forms a sound moving passage of acoustic modules (e.g., the audio module 170) such as an internal speaker (e.g., the sound output device 155 or the speaker 330 in FIG. 3) and a microphone (for example, the input device 150 or the first microphone 351 in FIG. 3). In the process of determining whether the acoustic device is worn, the control module 200 may perform a function of determining whether the nozzle portion of the acoustic device is blocked, when the nozzle portion is blocked, the control module 200 may perform a function of determining whether the nozzle portion is inserted into the user's ear or blocked by another object (e g, hand), and when the nozzle portion is inserted into the user's ear, the control module 200 may perform a function of determining whether the nozzle portion is worn in a completely inserted state or in an incompletely inserted state. Referring to FIG. 2, the control module 200 may include a signal output module 210, a signal reception module 220, a signal analysis module 230, a state determination module 240, a function selection module 250, and a state detection module 260.

The signal output module 210 may output an acoustic signal (or a sound) through a speaker (e.g., the sound output device 155 in FIG. 1 or the speaker 330 in FIG. 3) included in the acoustic device. According to an embodiment, the signal output module 210 may output a first signal for determining the blocked state of the nozzle portion through the speaker. Here, the first signal may include a signal in the non-audible band (e.g., 30 Hz or less). According to an embodiment, when it is detected that the acoustic device is fastened to a cradle for charging and storing via the state detection module 260, the signal output module 210 may perform control such that the first signal is not output. For example, the signal output module 210 may output the first signal through the speaker only when the acoustic device is separated from the cradle.

According to an embodiment, the signal output module 210 may determine the magnitude (output intensity) of the first signal depending on the noise level of the surrounding environment of the acoustic device. For example, the signal output module 210 may increase the magnitude of the first signal as the noise value indicating the noise level becomes larger (in a noisier environment), and may decrease the magnitude of the first signal as the noise value becomes smaller (in a quieter environment). In this case, the magnitude of the first signal may be determined within a predetermined range. According to an embodiment, the noise level may be determined by analyzing an acoustic signal received through an external microphone (e.g., the second microphone 353 in FIG. 3) of the acoustic device. For example, the signal reception module 220 transmits the acoustic signal received through the external microphone to the signal analysis module 230, and the signal analysis module 230 analyzes the acoustic signal so as to determine the noise level.

The signal output module 210 may output a third signal through the speaker when it is determined, through the state determination module 240, that the nozzle portion is blocked (the protruding end surface of the nozzle portion is blocked). Here, the third signal may include a signal of a low-frequency band (e.g., 300 Hz or less) and a signal of a high-frequency band (e.g., 300 Hz to 2 kHz). In some embodiments, the third signal may include only the high-frequency signal. The third signal may be configured in the form of a simple signal sound (e.g., a beep sound) including only the minimum frequency components necessary to determine whether the acoustic device is worn, in the form of a complex signal sound in which various sounds are mixed, or in the form of music. According to an embodiment, the signal output module 210 may output the third signal for a predetermined time through the speaker. The predetermined time may be a short time, for example, within a few seconds.

The signal reception module 220 may receive a second signal corresponding to the first signal through an internal microphone (e.g., the input device 150 in FIG. 1 or the first microphone 351 in FIG. 3) disposed inside the acoustic device. The second signal may include a signal introduced into the internal microphone as the first signal output from the speaker is at least partially reflected from the nozzle portion of the acoustic device. The signal reception module 220 may transmit the received second signal to the signal analysis module 230.

The signal reception module 220 may receive a fourth signal corresponding to the third signal through the internal microphone. The fourth signal may include a signal introduced into the internal microphone as a part of the third signal output from the speaker is reflected by the nozzle portion of the acoustic device, and a signal introduced into the internal microphone as another part of the third signal output from the speaker is reflected from the inside of the user's ear. For example, the signal reception module 220 may receive, through the internal microphone, a fifth signal generated as a part of the third signal is reflected by the nozzle portion within a first time range and a sixth signal generated as another part of the third signal is reflected from the inside of the user's ear within a second time range. Here, the first time range may correspond to a time interval earlier than the second time range. The signal reception module 220 may transmit the received fourth signal (including the fifth signal and the sixth signal) to the signal analysis module 230.

The signal analysis module 230 may analyze the second signal and/or the fourth signal (including the fifth signal and the sixth signal) received from the signal reception module 220. For example, the signal analysis module 230 may analyze response characteristics of the second signal and/or the fourth signal. The signal analysis module 230 may analyze the magnitudes of the second signal and/or the fourth signal for each frequency band through the frequency component analysis of the second signal and/or the fourth signal. For example, the signal analysis module 230 may transmit the analysis results of the second signal and/or the fourth signal to the state determination module 240.

The state determination module 240 may determine the state of the acoustic device through the analysis results of the second signal and/or the fourth signal received from the signal analysis module 230.

According to an embodiment, when the magnitude of the second signal received through the internal microphone is greater than a predetermined value, the state determination module 240 may determine that the nozzle portion of the acoustic device is in the blocked state (the protruding end surface of the nozzle portion being in the blocked state). This is because, when the nozzle portion is blocked, most of the first signal output from the speaker is reflected by the nozzle portion (reflected from the protruding end surface of the nozzle portion) and flows into the internal microphone. In addition, when the magnitude of the second signal is less than or equal to the predetermined value, the state determination module 240 may determine that the nozzle portion of the acoustic device is in a non-blocked state (e.g., an off state, a charging state, or a standby state). This is because, when the nozzle portion is in the non-blocked, most of the first signal output from the speaker is emitted to the outside through the nozzle portion.

According to an embodiment, when the third signal output from the speaker includes only a signal of a high-frequency band (e.g., 300 Hz to 2 kHz) and the magnitude of the fourth signal received through the internal microphone is greater than a predetermined value, the state determination module 240 may determine that the acoustic device is not worn in the user's ear. In the state in which the acoustic device is not worn in the user's ear and the nozzle portion of the acoustic device is blocked by another object (e g, hand) (in the state in which the protruding end surface of the nozzle portion is blocked by the another object), most of the third signal output from the third speaker is reflected by the nozzle portion (reflected by the another object blocking the protruding end surface of the nozzle portion) and flows into the internal microphone. In addition, when the magnitude of the fourth signal is less than or equal to the predetermined value, the state determination module 240 may determine that the nozzle portion of the acoustic device is in the state of being worn in the user's ear. This is because most of the third signal output from the speaker flows into the user's ear when the acoustic device is worn in the user's ear.

In the state in which the nozzle portion is blocked, the function of determining whether the nozzle portion part is inserted into the user's ear or is blocked by another object (e.g., hand) may be performed based on the response characteristics of an acoustic signal (e.g., the third signal) depending on the volume of an acoustic signal movement conduit. The volumes of the acoustic signal movement conduits when the nozzle portion is in the state of being blocked by another object and when the acoustic device is in the state of being inserted into the ear may be different from each other and thus the response characteristics of acoustic signals may also be different from each other. For example, the volume of the acoustic signal movement conduit when the nozzle portion is blocked by another object corresponds to the volume from the output portion of the speaker to the end of the nozzle portion, but the volume of the acoustic signal movement conduit when the acoustic device is in the state of being inserted into the ear may correspond to the volume from the output portion of the speaker to the internal space of the user's ear. That is, the volume of the acoustic signal movement conduit when the acoustic device is worn in the ear may be greater than the volume of the acoustic signal movement conduit when the nozzle portion is blocked by another object. Accordingly, when the volume difference is modeled with a filtering structure (e.g., a band stop filter structure), a filtering frequency (e.g., a notch frequency) moves to a low frequency band as the volume increases, and thus a sound pressure difference may occur in a high-frequency band (e.g., 1 kHz to 2 kHz). Due to the sound pressure difference, a difference (about 20 dB) may occur between the response characteristics of the acoustic signals when the nozzle portion is blocked by another object and when the acoustic device is worn in the user's ear.

According to an embodiment, when the third signal output from the speaker includes a signal of a low-frequency band (e.g., 300 Hz or lower) and a signal of a high-frequency band (e.g., 300 Hz to 2 kHz) and the magnitude of the fourth signal received through the internal microphone in the first frequency band (e.g., the high-frequency band) is greater than a predetermined first value, the state determination module 240 may determine that the acoustic device is not worn in the user's ear. In addition, when the magnitude of the first frequency band component of the fourth signal is smaller than the first value and the magnitude of the second frequency band (e.g., the low-frequency band) component of the fourth signal is greater than a predetermined second value, the state determination module 240 may determine that the acoustic device is normally worn in the user's ear. In addition, when the magnitude of the first frequency band component of the fourth signal is smaller than the first value and the magnitude of the second frequency band component of the fourth signal is equal to or smaller than the second value, the state determination module 240 may determine that the acoustic device is incompletely worn in the user's ear (e.g., the state in which the nozzle portion is not in close contact with the external auditory meatus).

The function selection module 250 may select different functions depending on the states of a plurality of acoustic devices and may perform the selected function. For example, in an environment in which a first acoustic device (or a first earpiece) and a second acoustic device (or a second earpiece) operate in conjunction, the function selection module 250 may select and perform different functions depending on the state of the first acoustic device and the second acoustic device.

According to an embodiment, in the state in which the first acoustic device (the state in which the nozzle portion part is blocked but not worn in the user's ear) is not worn and in the state in which the second acoustic device is not worn, the function selection module 250 may perform a device registration function for the first acoustic device and the second acoustic device. For example, the function selection module 250 may device-register (or use-register) the first acoustic device and the second acoustic device in an external device using a communication scheme such as Bluetooth. According to an embodiment, when the first acoustic device and the second acoustic device are already registered in an external electronic device, the function selection module 250 may not perform the device registration function in the state in which the first acoustic device is not worn and in the state in which the second acoustic device is not worn. For example, the function selection module 250 may perform control such that the device registration process is performed only once for the first acoustic device and the second acoustic device.

According to an embodiment, when the first acoustic device (or the second acoustic device) is detached from the cradle or is in the worn state, the function selection module 250 may pair (or connect) the first acoustic device (or the second acoustic device) with an external electronic device. For example, when the first acoustic device (or the second acoustic device) is separated from the cradle or is worn in the state in which the first acoustic device (or the second acoustic device) is device-registered in the external device, the selection module 250 may automatically pair the first acoustic device (or the second acoustic device) with the external electronic device.

According to an embodiment, in the state in which the first acoustic device is worn and in the state in which the second acoustic device is worn, the function selection module 250 may perform a sound reproduction function through the first acoustic device and the second acoustic device. The sound reproduction function through the first acoustic device and the second acoustic device may include a function of reproducing music or a sound of a video.

According to an embodiment, in the state in which one acoustic device (e.g., the first acoustic device) is worn and in the state in which another acoustic device (e.g., the second acoustic device) is not blocked, the function selection module 250 may perform the sound reproduction function through the acoustic device, which is in the worn state. The sound reproduction function through the one acoustic device, which is in the worn state, may include a function of reproducing music, a sound of a video, or a call sound. When performing the function of reproducing the call sound, the one acoustic device, which is in the worn state, may receive the user's voice through a microphone included in the acoustic device.

According to an embodiment, in the state in which one acoustic device (e.g., the first acoustic device) is worn and in the state in which another acoustic device (e.g., the second acoustic device) is not worn (in the state in which the nozzle portion is not blocked but is not worn in the user's ear), the function selection module 250 may cause the call sound to be reproduced through the acoustic device, which is in the worn state, and may cause the user's voice to be received through the microphone included in the acoustic device, which is in the non-worn state. For example, the acoustic device, which is in the worn state, may be used as a receiver for reception, and the acoustic device, which is in the non-worn state, may be used as a microphone for transmission.

According to an embodiment, in the state in which the nozzle portion of one acoustic device (e.g., the first acoustic device) is not blocked (e.g., an off state, a charging state, or a standby state) and in the state in which another acoustic device (e.g., the second acoustic device) is not worn (in the state in which the nozzle portion is blocked but is not worn in the user's ear), the function selection module 250 may receive the user's voice through the microphone included in the acoustic device, which is in the non-worn state. For example, the acoustic device, which is in the non-worn state, may be used as a microphone for recording. In some embodiments, the function selection module 250 may cause the user's voice to be received through the microphone included in the acoustic device, which is in the non-worn state, and may cause a call sound to be reproduced through the speaker (or the receiver) of the external device (e.g., a smart phone) connected (paired) with the acoustic device, which is in the non-worn state. For example, the acoustic device, which is in the non-worn state, may be used as a microphone for transmission, and the external electronic device may be used as a receiver for reception.

According to an embodiment, in the state in which the first acoustic device is worn and in the state in which the second acoustic device is worn, when the state determination module 240 determines that the first acoustic device and the second acoustic device are worn in different users' ears, respectively, the function selection module 250 may control the first acoustic device and the second acoustic device such that a stereo function is not supported. For example, when the first acoustic device is worn in the ear of a first user and the second acoustic device is worn in the ear of a second user, the state determination module 240 may determine that the first acoustic device and the second acoustic device are respectively worn in the ears of different users under the determination that the response characteristics of acoustic signals are different from each other due to the difference between the internal spaces of the ears of the first user and the second user (because the volumes of the acoustic signal movement conduits may be different).

According to an embodiment, in the state in which at least one acoustic device is incompletely worn (in the state in which the nozzle portion of the acoustic device is not in close contact with the ear canal), the function selection module 250 may provide an information providing function for normal wearing of the acoustic device. For example, the function selection module 250 may output an acoustic signal corresponding to information for normal wearing through the speaker of the acoustic device, which is incompletely worn. Alternatively, the function selection module 250 may perform control such that the information is transmitted to an external electronic device and an acoustic signal corresponding to the information is output through the speaker of the external electronic device or a display object corresponding to the information is output through a display of the external electronic device. In this case, the information for normal wearing may include at least one of, for example, information for guiding re-wearing of the acoustic device, which is incompletely worn, or information for guiding replacement of an accessory (e.g., an ear tip) of the acoustic device.

The state detection module 260 may detect the proximity or close contact of the acoustic device with respect to the user's ear through at least one sensor (e.g., the sensor module 176 in FIG. 1 or a proximity sensor 370 in FIG. 3) included in the acoustic device. For example, the state detection module 260 may receive a sensing value from the at least one sensor as the acoustic device approaches or comes into close contact with the user's ear, and may detects the state of the acoustic device, which approaches or comes into close contact with the user's ear by analyzing the sensing value. Accordingly, the state determination module 240 may determine the state of the acoustic device more accurately based on the state of the acoustic device detected by the state detection module 260.

The state detection module 260 may detect whether the acoustic device is fastened to a cradle or separated from the cradle through at least one sensor (e.g., the sensor module 176 in FIG. 1 or the Hall sensor 390 in FIG. 3) included in the acoustic device. For example, the state detection module 260 may receive, from the at least one sensor, a sensing value according to the state in which the acoustic device is fastened to the cradle or a sensing value according to the state in which the acoustic device is separated from the cradle, and may detect the state of the acoustic device fastened to the cradle or separated from the cradle by analyzing the sensing values. For example, the at least one sensor may be a Hall sensor (e.g., the Hall sensor 390 in FIG. 3), and a magnetic body may be disposed on the cradle.

FIG. 3 is a view illustrating an acoustic device according to an embodiment of the disclosure.

Referring to FIG. 3, an acoustic device (e.g., the electronic device 101) may include at least one processor 310, a speaker 330, a first microphone 351, a second microphone 353, the proximity sensor 370, and a Hall sensor 390. However, the configuration of the acoustic device is not limited thereto. According to an embodiment, at least one of the above-described components may be omitted from the acoustic device, or the acoustic device may further include one or more other components. For example, at least one of the second microphone 353, the proximity sensor 370, or the Hall sensor 390 may be omitted from the acoustic device. As another example, the acoustic device may further include a communication circuit (e.g., the communication module 190) for communicating with an external electronic device. As another example, the acoustic device may include a plurality of speakers.

Although not illustrated, the acoustic device may include a housing forming an appearance of the acoustic device. The housing may include a front surface, a rear surface, and a side surfaces at least partially surrounding the space between the front surface and the rear surface. The housing may include a seating portion on which various electronic components of the acoustic device are seated, and may cover the electronic components mounted on the seating portion so as to protect the electronic components from the outside. The housing may include a nozzle portion having a protruding structure configured to be inserted into a user's ear. According to an embodiment, the nozzle portion may protrude in a substantially cylindrical shape in an outward direction from a portion of the rear surface of the housing. In addition, the nozzle portion may include a sound hole penetrated from the rear surface of the housing to the end surface protruding outward. The sound hole may include, for example, a speaker hole in communication with an output portion of the speaker 330 and a microphone hole in communication with an input portion of the first microphone 351.

The processor 310 may control functions related to signal output, signal reception, signal analysis, state determination, function selection, and state detection of the acoustic device. For example, the processor 310 may perform a function, which is the same as or similar to that of the control module 200 in FIG. 2. The processor 310 may be disposed inside the housing. According to an embodiment, the processor 310 may be mounted on a printed circuit board (not illustrated) disposed inside the acoustic device.

The speaker 330 may convert an electrical signal into a sound (an acoustic signal) and may output the sound to the speaker hole through the output portion. According to an embodiment, the speaker 330 may receive an electrical signal from the processor 310. The speaker 330 may be disposed inside the housing. According to an embodiment, the speaker 330 may be mounted on the printed circuit board or electrically connected to the printed circuit board, and may be electrically connected to the processor 310.

The first microphone 351 may convert the sound coming through the microphone hole into an electrical signal. For example, the first microphone 351 may convert the received sound into an electrical signal when the sound introduced through the microphone hole enters the input portion of the first microphone 351. In addition, the first microphone 351 may transmit the converted electric signal to the processor 310. The first microphone 351 may be disposed inside the housing as the internal microphone. According to an embodiment, the first microphone 351 may be mounted on the printed circuit board or electrically connected to the printed circuit board, and may be electrically connected to the processor 310.

In addition, the second microphone 353 may also convert a sound into an electric signal, and may transmit the converted electric signal to the processor 310. The second microphone 353 may receive a sound through a microphone hole formed through one surface of the housing as an external microphone. Here, from the term "external microphone", it may be understood that a sound is received through the microphone hole formed outside the nozzle portion (a portion where the nozzle portion is not disposed) instead of the microphone hole formed in the nozzle portion. For example, although the second microphone 353 is named as an external microphone, the second microphone 353 is not practically disposed outside the housing (e.g., on the outer surface of the housing), and the second microphone 353 may be disposed inside the housing and may be connected to a microphone hole which is formed outside the nozzle portion and through one surface of the housing.

The proximity sensor 370 may detect whether an approaching object is present or whether an object is present at a proximate location. For example, the proximity sensor 370 may measure a sensing value according to the presence or absence of an object approaching a predetermined detection surface or an object present in the vicinity of the predetermined detection surface, and may transmit the measured sensing value to the processor 310. In this case, the processor 310 may analyze the sensing value so as to determine the presence or absence of an object approaching the acoustic device or an object present at a position proximate to the acoustic device. For example, the processor 310 may determine whether the acoustic device approaches the user's ear, is inserted into the user's ear, or is in close contact with the inside of the user's ear by analyzing the sensing values received from the proximity sensor 370. The proximity sensor 370 may detect the approach of an object in an inductive, capacitive, ultrasonic, or photoelectric manner. The proximity sensor 370 may be disposed inside the housing. According to an embodiment, the proximity sensor 370 may be mounted on the printed circuit board or electrically connected to the printed circuit board, and may be electrically connected to the processor 310.

The Hall sensor 390 may sense magnetism. The Hall sensor 390 may transmit a detected magnetic value to the processor 310. In this case, the processor 310 may analyze the magnetic value so as to determine whether the acoustic device comes close to or goes away from the magnetic body, and may also determine the distance of the acoustic device from the magnetic body. For example, when the magnetic body is disposed on a cradle for charging and storing the acoustic device, the processor 310 may determine whether the acoustic device is fastened to the cradle or separated from the cradle by analyzing the magnetic value detected by the Hall sensor 390. The Hall sensor 390 may be disposed inside the housing. According to an embodiment, the Hall sensor 390 may be mounted on the printed circuit board or electrically connected to the printed circuit board, and may be electrically connected to the processor 310.

As described above, according to an embodiment, an acoustic device (e.g., the electronic device 101 in FIG. 1 or the acoustic device in FIG. 3) may include: a housing; a nozzle portion protruding outwards from one surface of the housing; a speaker hole penetrating the housing from an inner surface of the housing to a protruding end surface of the nozzle portion; a first microphone hole penetrating the housing from the inner surface of the housing to the protruding end surface of the nozzle portion; a speaker (e.g., the sound output device 155 in FIG. 1 or the speaker 330 in FIG. 3) disposed inside the housing and connected to the speaker hole; a first microphone (e.g., the input device 150 in FIG. 1 or the first microphone 351 in FIG. 3) disposed inside the housing and connected to the first microphone hole; and a processor (e.g., the processor 120 in FIG. 1 or the processor 310 in FIG. 3) disposed inside the housing and electrically connected to the speaker and the first microphone. The processor may be configured to: output a first signal through the speaker; receive a second signal corresponding to the first signal through the first microphone; output a third signal through the speaker when a magnitude of a first frequency band component of the second signal is greater than a first value; receive a fourth signal corresponding to the third signal through the first microphone; and determine that the protruding end surface of the nozzle portion is blocked but the acoustic device is not worn in a user's ear when a magnitude of a second frequency band component of the fourth signal is greater than a second value.

According to an embodiment, the first signal may include a signal in a non-audible band lower than the first frequency, and the third signal may include a signal in a high-frequency band higher than the second frequency.

According to an embodiment, the third signal may further include a signal in a low-frequency band lower than the third frequency.

According to an embodiment, the acoustic device may further include: a second microphone hole penetrating a portion of the one surface of the housing in which the nozzle portion is not disposed; and a second microphone (e.g., the input device 150 in FIG. 1 or the second microphone 353 in FIG. 3) disposed inside the housing, connected to the second microphone hole, and electrically connected to the processor. The processor may be configured to: receive an external acoustic signal through the second microphone; and determine an output intensity of the first signal based on an analysis result of the received acoustic signal.

According to an embodiment, the processor may be configured to: when the magnitude of the first frequency band component of the second signal is equal to or less than the first value, re-output the first signal through the speaker, re-receive the second signal corresponding to the re-output first signal through the first microphone, and re-determine whether the magnitude of the first frequency band component of the re-received second signal is greater than the first value.

According to an embodiment, the processor may be configured to: when the magnitude of a third frequency band component of the fourth signal is equal to or less than a third value, re-output the first signal through the speaker, re-receive the second signal corresponding to the re-output first signal through the first microphone, and re-determine whether the magnitude of the first frequency band component of the re-received second signal is greater than the first value.

According to an embodiment, the processor may be configured to: determine that the nozzle portion is in a normally worn state in which the nozzle portion is inserted into the user's ear and is in close contact with an ear canal when the magnitude of a third frequency band component of the fourth signal is greater than a third value; and determine that the nozzle portion is in the incompletely worn state in which the nozzle portion is inserted into the user's ear but is not in close contact with the ear canal when the magnitude of the third frequency band component of the fourth signal is equal to or smaller than the third value.

According to an embodiment, the acoustic device may further include a proximity sensor (e.g., the sensor module 176 in FIG. 1 or the proximity module in FIG. 3) and the processor may be configured to: acquire a sensing value depending on presence or absence of an object approaching or located in a vicinity of the acoustic device through the proximity sensor; and determine a state of the acoustic device based on an analysis result of the fourth signal and an analysis result of the sensing value.

According to an embodiment, the acoustic device may further include a Hall sensor (e.g., the sensor module 176 in FIG. 1 or the Hall sensor 390 in FIG. 3), and the processor may be configured to: acquire a magnetic value depending on presence or absence of a magnetic body approaching or located in a vicinity of the acoustic device through the Hall sensor; determine whether the acoustic device is fastened to the cradle including the magnetic body based on an analysis result of the magnetic value; and controls the speaker not to output the first signal when the acoustic device is fastened to the cradle.

According to an embodiment, the acoustic device may further include a communication circuit (e.g., the communication module 190 in FIG. 1) configured to communicate with an external electronic device, and the processor may be configured to: output an acoustic signal corresponding to information about a state of the acoustic device through the speaker; or transmit the information to the external electronic device through the communication circuit.

According to an embodiment, the acoustic device may further include: a communication circuit (e.g., the communication module 190 in FIG. 1) configured to communicate with another external electronic device, and the processor may be configured to: receive first information about a state of the another acoustic device from the another acoustic device through the communication circuit; determine a state of the another acoustic device based on an analysis result of the first information; select a first function to be performed by the acoustic device and a second function to be performed by the another acoustic device based on the state of the acoustic device and the state of the another acoustic device; perform the first function; and transmit second information corresponding to the second function to the another acoustic device through the communication circuit.

Figure 4:
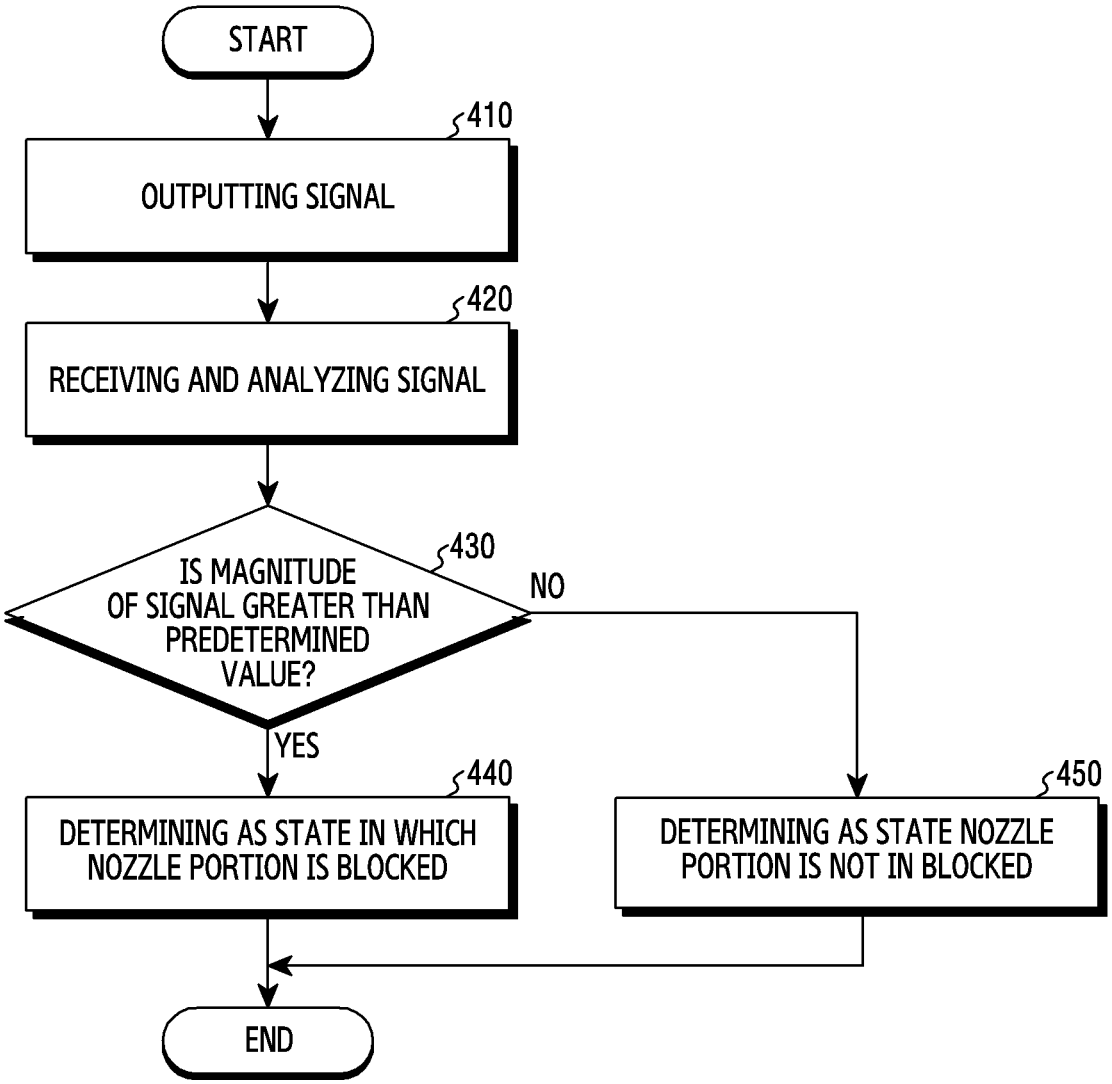
FIG. 4 illustrates a method of determining whether a nozzle portion included in an acoustic device is opened or closed according to an embodiment of the disclosure.

FIG. 4 is a view for describing a method of determining whether a nozzle portion included in an acoustic device is opened or closed according to an embodiment of the disclosure.

Referring to FIG. 4, in operation 410, an acoustic device (e.g., the electronic device 101 in FIG. 1 or the acoustic device in FIG. 3) may output a signal (hereinafter referred to as a "first signal") through a speaker (e.g., the sound output device 155 in FIG. 1 or the speaker 330 in FIG. 3) included in the acoustic device. According to an embodiment, the first signal may include a signal in the non-audible band (e.g., 30 Hz or less).

According to an embodiment, the acoustic device may determine the magnitude (output intensity) of the first signal depending on the noise level of the surrounding environment of the acoustic device. The acoustic device may calculate a noise value indicating the noise level by analyzing an acoustic signal received through an external microphone (e.g., the input device 150 in FIG. 1 or the second microphone 353 in FIG. 3) thereof, may increase the magnitude of the first signal as the noise value is larger (in a noisier environment), and may reduce the magnitude of the first signal as the noise value is smaller (in a quieter environment).

In operation 420, the acoustic device may receive and analyze a signal (hereinafter, referred to as a "second signal") through an internal microphone (e.g., the input device 150 in FIG. 1 or the first microphone 351 in FIG. 3) included therein. Here, the second signal may include a signal introduced into the internal microphone as the first signal output from the speaker is at least partially from the nozzle portion of the acoustic device. The acoustic device may analyze the magnitude of the second signal for each frequency band through the frequency component analysis of the second signal.

In operation 430, the acoustic device may determine whether the magnitude of the received signal (second signal) is greater than a predetermined value. For example, the acoustic device may determine whether the magnitude of a specific frequency band component included in the second signal is greater than a predetermined value.

Under the determination that the magnitude of the received signal (second signal) is greater than the predetermined value, the acoustic device may determine that the nozzle portion thereof is blocked in operation 440.

Under the determination that the magnitude of the received signal (second signal) is equal to or smaller than the predetermined value, the acoustic device may determine that the nozzle portion thereof is not blocked in operation 450.

Figure 5:
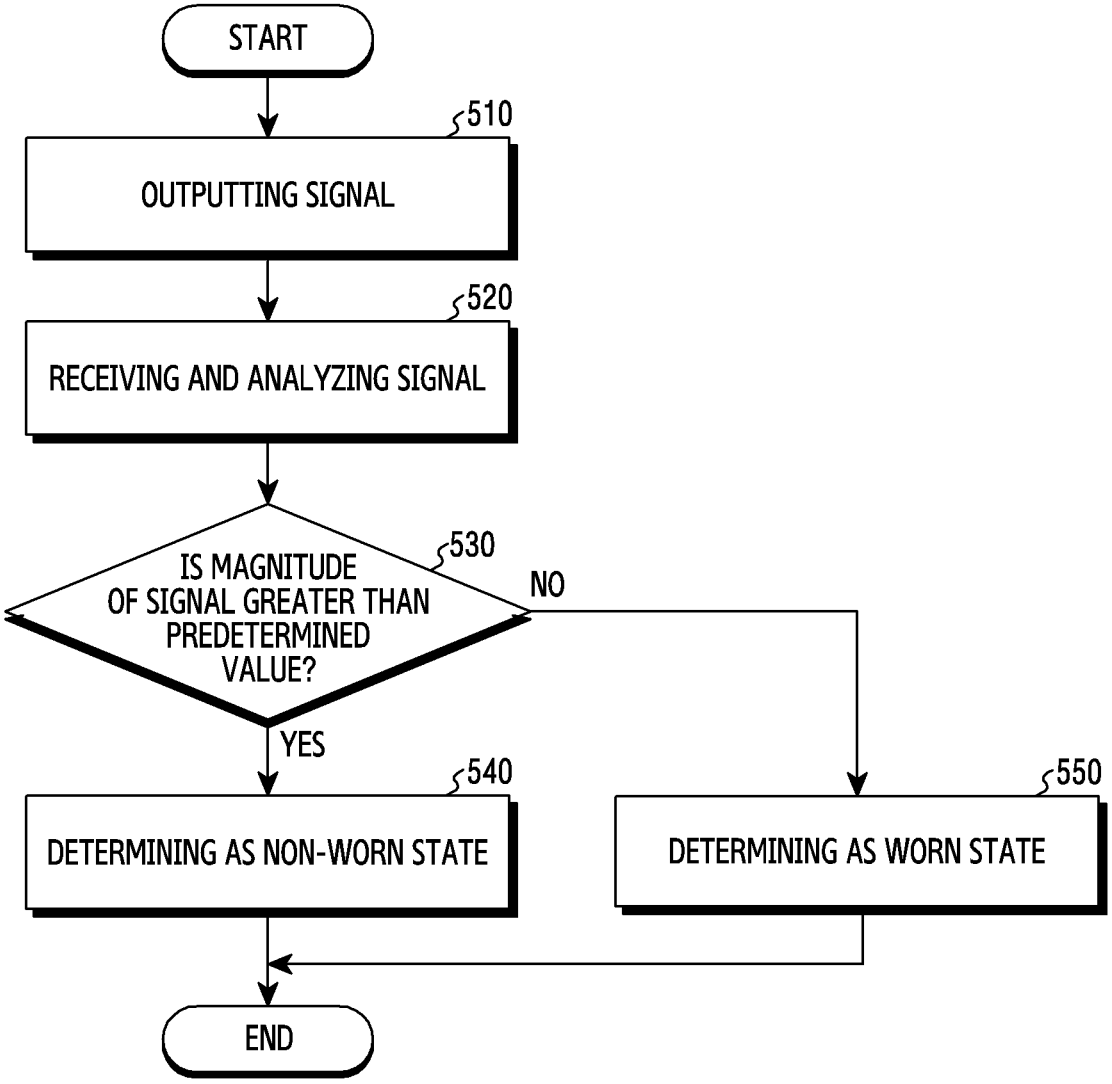
FIG. 5 illustrates a method of determining whether an acoustic device is worn in the state in which a nozzle portion is blocked according to an embodiment of the disclosure.

FIG. 5 is a view for describing a method of determining whether an acoustic device is worn in the state in which a nozzle portion is blocked according to an embodiment of the disclosure.

Referring to FIG. 5, in operation 510, an acoustic device (e.g., the electronic device 101 in FIG. 1 or the acoustic device in FIG. 3) may output a signal (hereinafter referred to as a "third signal") through a speaker (e.g., the sound output device 155 in FIG. 1 or the speaker 330 in FIG. 3) included in the acoustic device. According to an embodiment, the third signal may include a signal of a low-frequency band (e.g., 300 Hz or less) and a signal of a high-frequency band (e.g., 300 Hz to 2 kHz). In some embodiments, the third signal may include only the high-frequency signal. The third signal may be configured in the form of a simple signal sound including only the minimum frequency components necessary to determine whether the acoustic device is worn, in the form of a complex signal sound in which various sounds are mixed, or in the form of music. The complex signal sound may be, for example, a signal sound in which other signal sounds, such as a call sound, are mixed with the simple signal sound. According to an embodiment, the acoustic device may output the third signal for a predetermined time through the speaker. The predetermined time may be a short time, for example, within a few seconds.

In operation 520, the acoustic device may receive and analyze a signal (hereinafter, referred to as a "fourth signal") through an internal microphone (e.g., the input device 150 in FIG. 1 or the first microphone 351 in FIG. 3) included therein. Here, the fourth signal may include a fifth signal introduced into the internal microphone as a part of the third signal output from the speaker is reflected by the nozzle portion of the acoustic device, and a six signal introduced into the internal microphone as another part of the third signal output from the speaker is reflected from the inside of the user's ear. Here, the fifth signal and the sixth signal may be introduced into the internal microphone with a predetermined time difference. For example, the acoustic device may receive the fifth signal within a first time range and the sixth signal within a second time range later than the first time range, through the internal microphone. The acoustic device may analyze the magnitude of the fourth signal for each frequency band through the frequency component analysis of the fourth signal (including the fifth signal and the sixth signal).

In operation 530, the acoustic device may determine whether the magnitude of the received signal (fourth signal) is greater than a predetermined value. For example, the acoustic device may determine whether the magnitude of a specific frequency band component included in the fourth signal is greater than a predetermined value. Here, the specific frequency band component may be a component of a high-frequency band (e.g., 300 Hz to 2 kHz).

Under the determination that the magnitude of the received signal (fourth signal) is greater than the predetermined value, the acoustic device may determine that the acoustic device is not worn in the user's ear in operation 540. For example, when the magnitude of the high-frequency band component of the fourth signal is greater than the predetermined value, the acoustic device may determine that the acoustic device is in the non-worn state. The non-worn state is the state in which the nozzle portion of the acoustic device is blocked but is not worn in the user's ear, for example, the state in which the nozzle portion is blocked by another object such as the user's hand.

Under the determination that the magnitude of the received signal (fourth signal) is equal to or smaller than the predetermined value, the acoustic device may determine that the acoustic device is not worn in the user's ear in operation 550. For example, when the magnitude of the high-frequency band component of the fourth signal is equal to or smaller than the predetermined value, the acoustic device may determine that the acoustic device is in the worn state.

According to an embodiment, the predetermined value may be set differently for each user of the acoustic device. For example, since the magnitude of the received signal (fourth signal) may vary depending on the shape or volume of the internal space of the user's ear, the predetermined value may be set differently for each user. According to an embodiment, the acoustic device may set the predetermined value in the state in which the acoustic device is first worn in the user's ear.

Figure 6:
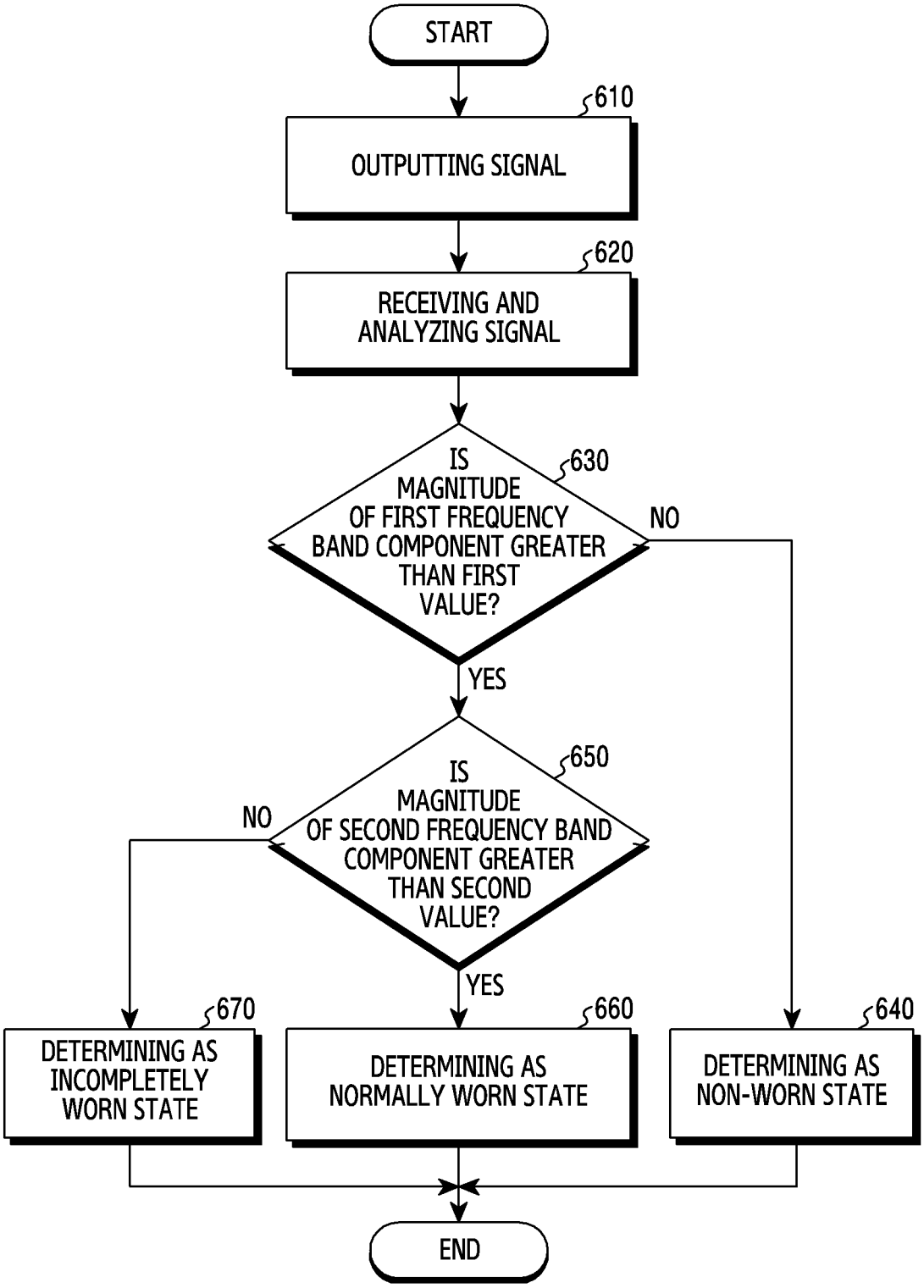
FIG. 6 illustrates a method of determining whether an acoustic device is worn in the state in which a nozzle portion is blocked according to an embodiment of the disclosure.

FIG. 6 is a view for describing a method of determining whether an acoustic device is worn in the state in which a nozzle portion is blocked in according to an embodiment of the disclosure.

Referring to FIG. 6, in operation 610, an acoustic device (e.g., the electronic device 101 in FIG. 1 or the acoustic device in FIG. 3) may output a signal (hereinafter referred to as a "third signal") through a speaker (e.g., the sound output device 155 in FIG. 1 or the speaker 330 in FIG. 3) included in the acoustic device. According to an embodiment, the third signal may include a signal of a low-frequency band (e.g., 300 Hz or less) and a signal of a high-frequency band (e.g., 300 Hz to 2 kHz).

In operation 620, the acoustic device may receive and analyze a signal (hereinafter, referred to as a "fourth signal" through an internal microphone (e.g., the input device 150 in FIG. 1 or the first microphone 351 in FIG. 3) included therein. Here, the fourth signal may include a fifth signal introduced into the internal microphone as a part of the third signal output from the speaker is reflected by the nozzle portion of the acoustic device in a first time range, and a six signal introduced into the internal microphone as another part of the third signal output from the speaker is reflected from the inside of the user's ear in a second time range. The acoustic device may analyze the magnitude of the fourth signal for each frequency band through the frequency component analysis of the fourth signal (including the fifth signal and the sixth signal).

In operation 630, the acoustic device may determine whether the magnitude of a first frequency band component of the received signal (fourth signal) is smaller than a first value. The first frequency band component may be a component of a high-frequency band (e.g., 1 kHz to 2 kHz).

Under the determination that the magnitude of the first frequency band component of the received signal (fourth signal) is not smaller than the first value, the acoustic device may determine that the acoustic device is not worn in the user's ear in operation 640. For example, when the magnitude of the high-frequency band component of the fourth signal is equal to or greater than the first value, the acoustic device may determine that the acoustic device is in the non-worn state. Here, the non-worn state is the state in which the nozzle portion of the acoustic device is blocked but is not worn in the user's ear, for example, the state in which the nozzle portion is blocked by another object such as the user's hand.

Under the determination that the magnitude of the first frequency band component of the received signal (fourth signal) is smaller than the first value, the acoustic device may determine whether the magnitude of the second frequency band component of the received signal (fourth signal) is greater than the second value in operation 650. The second frequency band component may be a component of a low-frequency band (e.g., 30 Hz to 300 Hz).

Under the determination that the magnitude of the second frequency band component of the received signal (fourth signal) is greater than the second value, the acoustic device may determine that the acoustic device is normally worn in the user's ear in operation 660. For example, when the magnitude of the low-frequency band component of the fourth signal is greater than the second value, the acoustic device may determine that the acoustic device is in the normally worn state.

Under the determination that the magnitude of the second frequency band component of the received signal (fourth signal) is not greater than the second value, the acoustic device may be determined that the acoustic device is incompletely worn in the user's ear in operation 670. For example, when the magnitude of the low-frequency band component of the fourth signal is equal to or smaller than the second value, the acoustic device may determine that the acoustic device is in the incompletely worn state. Here, the incompletely worn state may mean the state in which the acoustic apparatus is worn in the user's ear but the nozzle portion of the acoustic device is not in close contact with the ear canal.

Figure 7:
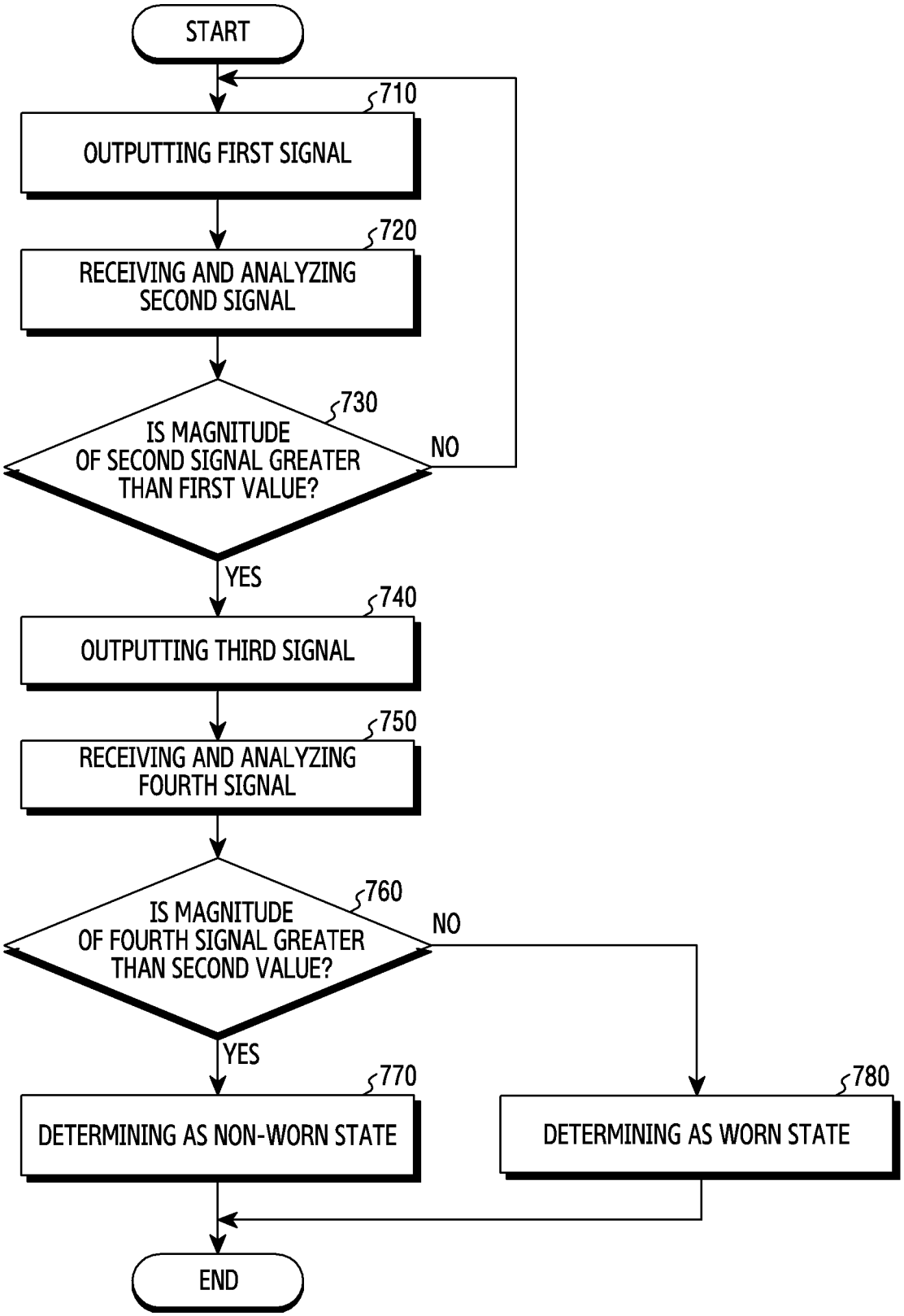
FIG. 7 illustrates a method of determining whether an acoustic device is worn according to an embodiment of the disclosure.

FIG. 7 is a view for describing a method of determining whether an acoustic device is worn in according to an embodiment of the disclosure.

Referring to FIG. 7, in operation 710, an acoustic device (e.g., the electronic device 101 in FIG. 1 or the acoustic device in FIG. 3) may output a first signal through a speaker (e.g., the sound output device 155 in FIG. 1 or the speaker 330 in FIG. 3) included in the acoustic device. Here, the first signal may be a signal in the non-audible band (e.g., 30 Hz or less). According to an embodiment, the acoustic device may determine the magnitude (output intensity) of the first signal depending on the noise level of the surrounding environment of the acoustic device.

In operation 720, the acoustic device may receive and analyze a second signal through an internal microphone (e.g., the input device 150 in FIG. 1 or the first microphone 351 in FIG. 3) included therein. Here, the second signal may include a signal introduced into the internal microphone as the first signal output from the speaker is at least partially from the nozzle portion of the acoustic device. The acoustic device may analyze the magnitude of the second signal for each frequency band through the frequency component analysis of the second signal.

In operation 730, the acoustic device may determine whether the magnitude of the second signal is greater than a first value. For example, the acoustic device may determine whether the magnitude of a specific frequency band component included in the second signal is greater than the first value.

Under the determination that the magnitude of the second signal is not greater than the first value, the acoustic device may return to operation 710. For example, when the magnitude of a specific frequency band component included in the second signal is equal to or less than the first value, the acoustic device may determine that that the nozzle portion thereof is not blocked, and thus may return to operation 710 so as to re-output the first signal.

According to an embodiment, when detecting that the acoustic device is fastened to a cradle, the acoustic device may perform control such that the first signal is not output. For example, the acoustic device may output the first signal through the speaker only when the acoustic device is separated from the cradle.

Under the determination that the magnitude of the second signal is not greater than the first value, the acoustic device may output a third signal through the speaker in operation 740. For example, the acoustic device may determine that the nozzle portion of the acoustic device is in the blocked state and may output the third signal through the speaker. Here, the third signal may include a signal of a low-frequency band (e.g., 300 Hz or less) and a signal of a high-frequency band (e.g., 300 Hz to 2 kHz). In some embodiments, the third signal may include only the high-frequency signal.

In operation 750, the acoustic device may receive and analyze the fourth signal through the internal microphone. Here, the fourth signal may include a fifth signal introduced into the internal microphone as a part of the third signal output from the speaker is reflected by the nozzle portion of the acoustic device in a first time range, and a six signal introduced into the internal microphone as another part of the third signal output from the speaker is reflected from the inside of the user's ear in a second time range. The acoustic device may analyze the magnitude of the fourth signal for each frequency band through the frequency component analysis of the fourth signal.

In operation 760, the acoustic device may determine whether the magnitude of the fourth signal is greater than a second value. For example, the acoustic device may determine whether the magnitude of a specific frequency band component included in the fourth signal is greater than the second value. Here, the specific frequency band component may be a component of a high-frequency band (e.g., 300 Hz to 2 kHz).

Under the determination that the magnitude of the fourth signal is greater than the second value, the acoustic device may determine that the acoustic device is not worn in the user's ear in operation 770. For example, when the magnitude of the high-frequency band component of the fourth signal is greater than the second value, the acoustic device may determine that the acoustic device is in the non-worn state. Here, the non-worn state is the state in which the nozzle portion of the acoustic device is blocked but is not worn in the user's ear, for example, the state in which the nozzle portion is blocked by another object such as the user's hand.

Under the determination that the magnitude of the fourth signal is not greater than the second value, the acoustic device may determine that the acoustic device is worn in the user's ear in operation 780. For example, when the magnitude of the high-frequency band component of the fourth signal is equal to or smaller than the second value, the acoustic device may determine that the acoustic device is in the worn state.

Figure 8:
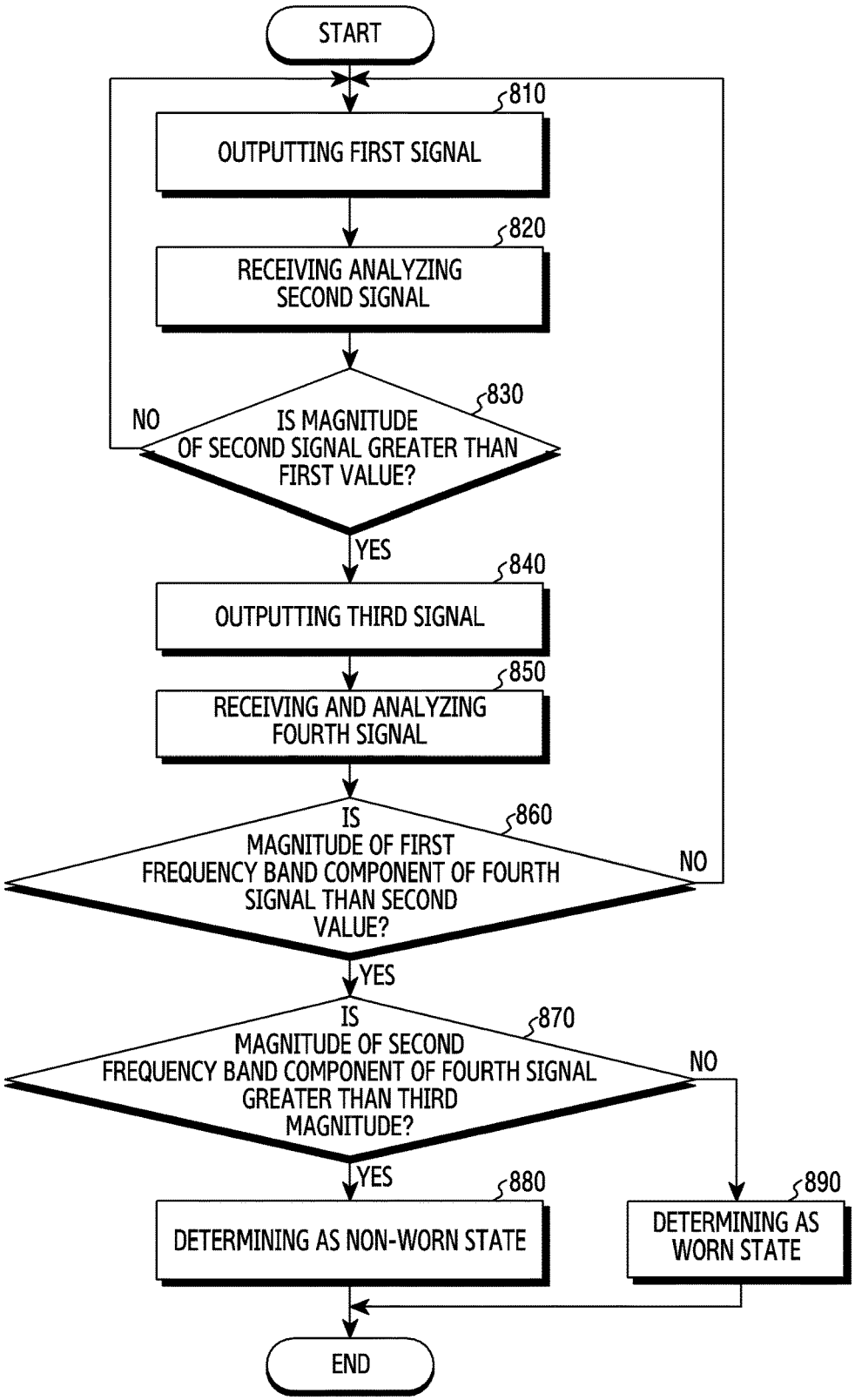
FIG. 8 illustrates another method of determining whether an acoustic device is worn according to an embodiment of the disclosure.

FIG. 8 is a view for describing another method of determining whether an acoustic device is worn in according to an embodiment of the disclosure.

Referring to FIG. 8, in operation 810, an acoustic device (e.g., the electronic device 101 in FIG. 1 or the acoustic device in FIG. 3) may output a first signal through a speaker (e.g., the sound output device 155 in FIG. 1 or the speaker 330 in FIG. 3) included in the acoustic device. Here, the first signal may be a signal in the non-audible band (e.g., 30 Hz or less). According to an embodiment, the acoustic device may determine the magnitude (output intensity) of the first signal depending on the noise level of the surrounding environment of the acoustic device.

In operation 820, the acoustic device may receive and analyze a second signal through an internal microphone (e.g., the input device 150 in FIG. 1 or the first microphone 351 in FIG. 3) included therein. Here, the second signal may include a signal introduced into the internal microphone as the first signal output from the speaker is at least partially from the nozzle portion of the acoustic device. The acoustic device may analyze the magnitude of the second signal for each frequency band through the frequency component analysis of the second signal.

In operation 830, the acoustic device may determine whether the magnitude of the second signal is greater than a first value. For example, the acoustic device may determine whether the magnitude of a specific frequency band component included in the second signal is greater than the first value.

Under the determination that the magnitude of the second signal is not greater than the first value, the acoustic device may return to operation 810. For example, when the magnitude of a specific frequency band component included in the second signal is equal to or less than the first value, the acoustic device may determine that that the nozzle portion thereof is not blocked, and thus may return to operation 810 so as to re-output the first signal.

According to an embodiment, when detecting that the acoustic device is not fastened to a cradle, the acoustic device may perform control such that the first signal is output. For example, the acoustic device may output the first signal through the speaker only when the acoustic device is separated from the cradle.

Under the determination that the magnitude of the second signal is not greater than the first value, the acoustic device may output a third signal through the speaker in operation 840. For example, the acoustic device may determine that the nozzle portion of the acoustic device is in the blocked state and may output the third signal through the speaker. Here, the third signal may include a signal of a low-frequency band (e.g., 300 Hz or less) and a signal of a high-frequency band (e.g., 300 Hz to 2 kHz).

In operation 850, the acoustic device may receive and analyze the fourth signal through the internal microphone. Here, the fourth signal may include a fifth signal introduced into the internal microphone as a part of the third signal output from the speaker is reflected by the nozzle portion of the acoustic device in a first time range, and a six signal introduced into the internal microphone as another part of the third signal output from the speaker is reflected from the inside of the user's ear in a second time range. The acoustic device may analyze the magnitude of the fourth signal for each frequency band through the frequency component analysis of the fourth signal.

In operation 860, the acoustic device may determine whether the magnitude of a first frequency band component of the fourth signal is greater than the second value. The first frequency band component may be a component of a low-frequency band (e.g., 300 Hz or less).

Under the determination that the magnitude of the first frequency band component of the fourth signal is not greater than the second value, the acoustic device may return to operation 810. For example, when the magnitude of a low-frequency band component included in the fourth signal is equal to or less than the second value, the acoustic device may determine that that the nozzle portion thereof is not blocked, and thus may return to operation 810 so as to re-output the first signal. That is, when the blocked state of the nozzle portion is released before it is determined that the nozzle portion of the acoustic device is in the blocked state and the third signal is output, the magnitude of the low-frequency band component of the fourth signal received after the third signal is output may be equal to or smaller than the second value. In this case, the acoustic device may return to operation 810.

Under the determination that the magnitude of the first frequency band component of the fourth signal is greater than the second value, the acoustic device may determine whether the magnitude of the second frequency band component of the fourth signal is greater than the third value in operation 870. The second frequency band component may be a component of a high-frequency band (e.g., 300 Hz to 2 kHz).

Under the determination that the magnitude of the second frequency band component of the fourth signal is greater than the third value, the acoustic device may determine that the acoustic device is not worn in the user's ear in operation 880. For example, when the magnitude of the high-frequency band component of the fourth signal is greater than the third value, the acoustic device may determine that the acoustic device is in the non-worn state. Here, the non-worn state is the state in which the nozzle portion of the acoustic device is blocked but is not worn in the user's ear, for example, the state in which the nozzle portion is blocked by another object such as the user's hand.

Under the determination that the magnitude of the second frequency band component of the fourth signal is not greater than the third value, the acoustic device may determine that the acoustic device is worn in the user's ear in operation 890. For example, when the magnitude of the high-frequency band component of the fourth signal is equal to or smaller than the third value, the acoustic device may determine that the acoustic device is in the worn state.

Figure 9:
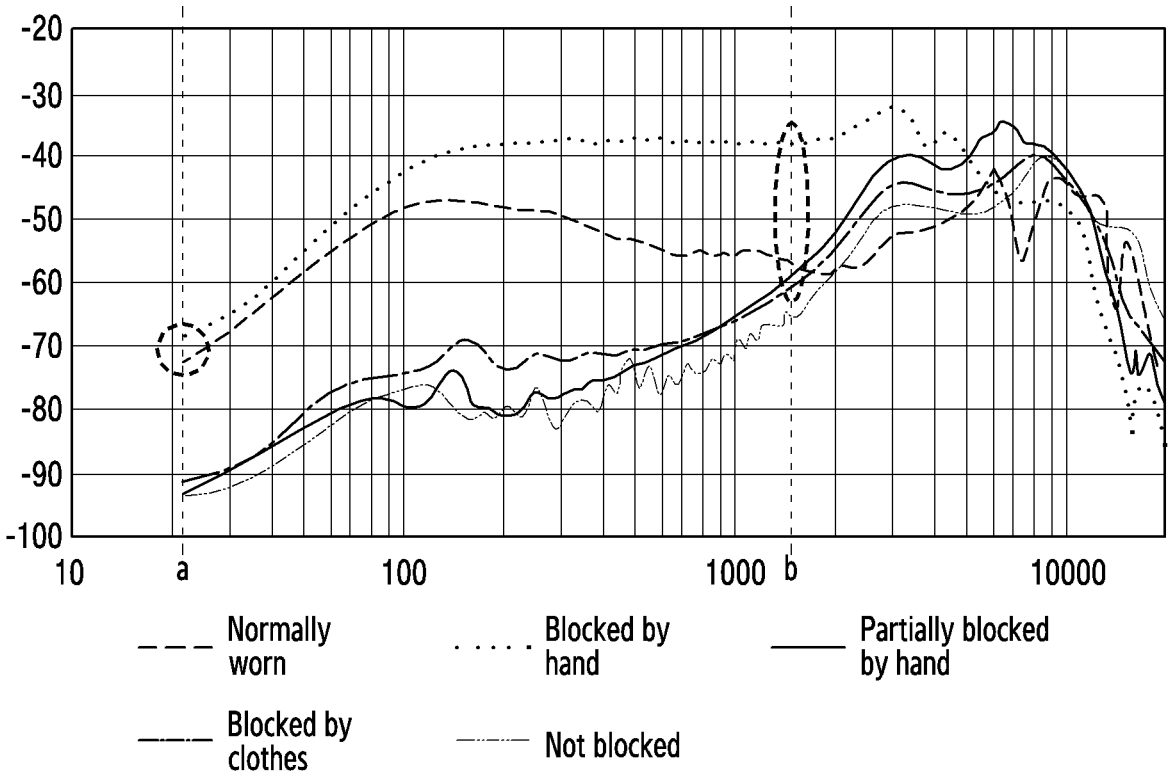
FIG. 9 illustrates signal response characteristics depending on the open/closed state of a nozzle portion according to an embodiment of the disclosure.

FIG. 9 is a view illustrating signal response characteristics depending on the open/closed state of a nozzle portion according to an embodiment of the disclosure.

Referring to FIG. 9, an acoustic device (e.g., the electronic device 101 in FIG. 1 or the acoustic device in FIG. 3) may determine the open/close state of the nozzle portion of the acoustic device based on a signal response characteristic using the speaker (e.g., the sound output device 155 or the speaker 330 in FIG. 1) and the internal microphone (e.g., the input device 150 in FIG. 1 or the first microphone 351 in FIG. 3) included therein. The graph illustrated in FIG. 9 represents signal response characteristics in a first state in which the acoustic device is normally worn in the user's ear, a second state in which the nozzle portion of the acoustic device is blocked by hand, a third state in which the nozzle portion is partially blocked by hand, a fourth state in which the nozzle portion is blocked by clothes and a fifth state in which the nozzle portion part is not blocked.

As in the graph illustrated in FIG. 9, based on signal response characteristics in a low-frequency band (e.g., 300 Hz or less), particularly, in the non-audible band a (e.g., 30 Hz or less), it is possible to distinguish the first state and the second state from the third state, the fourth state, and the fifth state. For example, in the non-audible band a, the magnitudes of a signal in the state in which the acoustic device is normally worn (first state) and the state in which the nozzle portion is blocked by hand (second state) may be greater than the magnitudes of a signal in the state in which the nozzle portion is partially blocked by hand (third state), the state in which the nozzle portion is blocked by clothes (fourth state), and the state in which the nozzle portion is not blocked (fifth state) by a predetermined magnitude (e.g., about 20 dB).

In addition, based on the signal response characteristics of a specific frequency band b (e.g., 1 kHz to 2 kHz) in the high-frequency band (e.g., 300 Hz to 2 kHz), it is possible to distinguish the first state and the second state. For example, in the specific frequency band b, the magnitude of a signal in the state in which the acoustic device is normally worn (first state) may be smaller than the magnitude of the signal in the state in which the nozzle portion is blocked by hand (second state) by a predetermined magnitude (e.g., about 20 dB).

Accordingly, based on the signal response characteristics in non-audible band a of the low-frequency band, the acoustic device is capable of determining whether the nozzle portion of the acoustic device is blocked, and based on the signal response characteristics in the specific frequency band b of the high-frequency band, it is possible to determine whether the nozzle portion is blocked by another object (e.g., a hand) or inserted into the user's ear if the nozzle portion is blocked.

Figure 10:
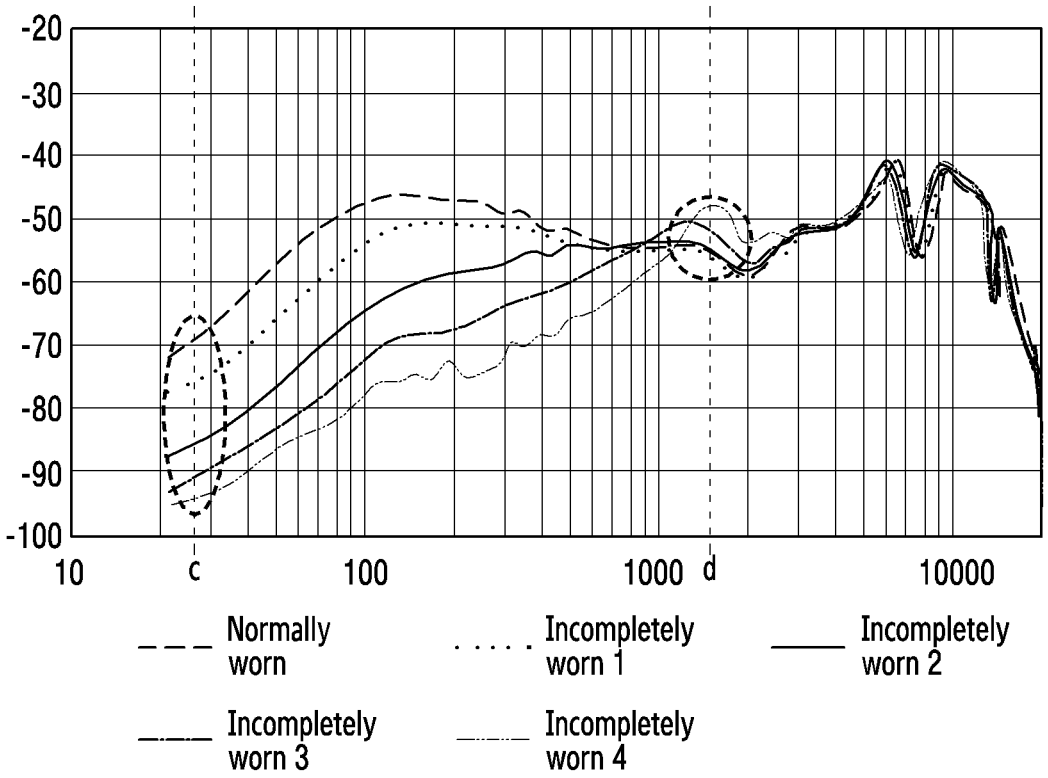
FIG. 10 illustrates signal response characteristics depending on the worn state of an acoustic device according to an embodiment of the disclosure.

FIG. 10 is a view illustrating signal response characteristics depending on the worn state of an acoustic device according to an embodiment of the disclosure.

Referring to FIG. 10, an acoustic device (e.g., the electronic device 101 in FIG. 1 or the acoustic device in FIG. 3) may determine the worn state of the acoustic device based on a signal response characteristic using the speaker (e.g., the sound output device 155 in FIG. 1 or the speaker 330 in FIG. 3) and the internal microphone (e.g., the input device 150 in FIG. 1 or the first microphone 351 in FIG. 3) included therein. The graph illustrated in FIG. 10 represents a first state in which the acoustic device is normally worn in the user's ear ("Normally Worn" in the graph), a second state in which the acoustic device is incompletely worn in the user's ear ("Incompletely Worn 1" in the graph), a third state in which the acoustic device is incompletely worn in the user's ear ("Incompletely Worn 2" in the graph), a fourth state in which the acoustic device is incompletely worn in the users ear ("Incompletely Worn 3" in the graph), and a fifth state in which the acoustic device is incompletely worn in the user's ear ("Incompletely Worn 4" in the graph). Here, the incompletely worn state may mean the state in which the nozzle portion of the acoustic device is not in close contact with the ear canal. In addition, the second state, the third state, the fourth state, and the fifth state may be the states occurring depending on a variation of the volume of a space (a variation of the spacing distance between the nozzle portion and the canal) caused when the nozzle portion is not in close contact with the ear canal.

As in the graph represented in FIG. 10, based on the signal response characteristics in a high-frequency band d (e.g., 1 kHz to 2 kHz), it is possible to distinguish the worn state (first to fifth states) of the acoustic device from the non-worn state. The worn state may include a normally worn state and an incompletely worn state.

In addition, based on the signal response characteristics in the low-frequency band c (e.g., 30 Hz to 300 Hz), it is possible to distinguish the normally worn state (the first state) and the incompletely worn state (e.g., the second to fifth states) of the acoustic device. For example, in the low-frequency band (c) of a signal, the magnitude of the signal in the normally worn state (first state) of the acoustic device may be greater than a predetermined magnitude, and the magnitudes of the signal in the incompletely worn states (second to fifth states) of the acoustic device may be equal to or less than the predetermined magnitude.

Accordingly, based on the signal response characteristics in the high-frequency band d, the acoustic device may determine whether the acoustic device is worn (whether the nozzle portion is inserted into the ear canal), and based on the signal response characteristics in the low-frequency band c, the acoustic device may determine whether the acoustic device is normally worn (whether the nozzle portion is completely inserted into the ear canal and is in close contact with the ear canal), or whether the acoustic device is incompletely worn (whether the nozzle portion is completely inserted into the ear canal and is not in close contact with the ear canal).

Figure 11:
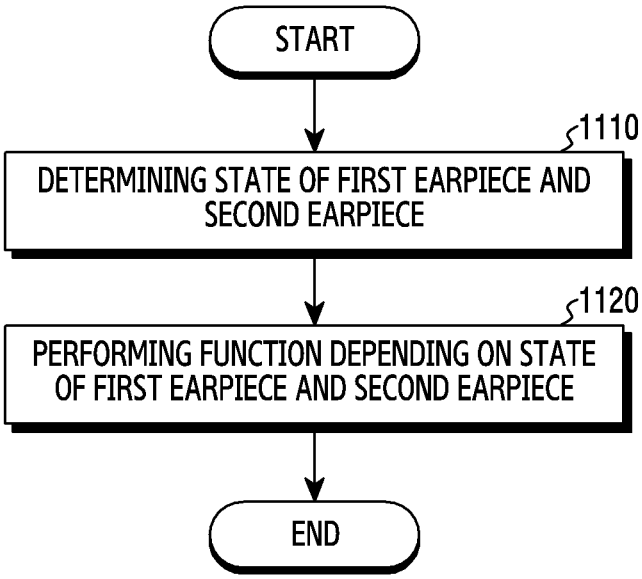
FIG. 11 illustrates how to execute a function depending on the states of a plurality of earpieces according to an embodiment of the disclosure.

FIG. 11 is a view for describing how to execute a function depending on the states of a plurality of earpieces according to an embodiment of the disclosure.

In an environment (hereinafter, referred to as a "system") in which a plurality of acoustic devices (or earpieces) operate in conjunction, the acoustic devices may perform different functions depending on the states of the acoustic devices. In the following description, for convenience of description, only the state in which the acoustic devices include the first earpiece and the second earpiece will be described. Here, the first earpiece and the second earpiece may include a configuration that is the same as or similar to that of the electronic device 101 of FIG. 1 or the acoustic device of FIG. 3.

Referring to FIG. 11, in operation 1110, the system may determine the states of the first earpiece and the second earpiece. For example, the first earpiece may output at least one signal (a first signal and/or a third signal) through the speaker (e.g., the sound output device 155 in FIG. 1 or the speaker 330 in FIG. 3) included therein, may receive and analyze at least one signal (a second signal and/or a fourth signal) corresponding to the at least one output signal through the internal microphone (e.g., the input device 150 in FIG. 1 or the first microphone 351 in FIG. 3) included therein, and may determine the state thereof based on analyzed results. In addition, the second earpiece may output at least one signal (a first signal and/or a third signal) through the speaker (e.g., the sound output device 155 in FIG. 1 or the speaker 330 in FIG. 3) included therein, may receive and analyze at least one signal (a second signal and/or a fourth signal) corresponding to the at least one output signal through the internal microphone (e.g., the input device 150 in FIG. 1 or the first microphone 351 in FIG. 3) included therein, and may determine the state thereof based on analyzed results.

When the states of the first earpiece and the second earpiece are determined, in operation 1120, the system may perform functions according to the states of the first earpiece and the second earpiece.

According to an embodiment, in the state in which the first earpiece is not worn (the state in which the nozzle portion is blocked bus is not worn in the user's ear) and in the state in which the second earpiece is not worn, the system may perform a device registration function for the first earpiece and the second earpiece. For example, the system may device-register (or use-register) the first earpiece and the second earpiece in the system or in an external device using a communication scheme such as Bluetooth.

According to an embodiment, in the state in which the first earpiece is worn and in the state in which the second earpiece is worn, the system may perform a sound reproduction function through the first earpiece and the second earpiece. The sound reproduction function through the first earpiece and the second earpiece may include a function of reproducing music or a sound of a video.

According to an embodiment, in the state in which one earpiece (e.g., the first earpiece) is worn and in the state in which another earpiece (e.g., the second earpiece) is not blocked, the system may perform the sound reproduction function through the earpiece, which is in the worn state. The sound reproduction function through the one earpiece device, which is in the worn state, may include a function of reproducing music, a sound of a video, or a call sound. When performing the function of reproducing the call sound, the one earpiece, which is in the worn state, may receive the user's voice through a microphone included therein.

According to an embodiment, in the state in which one earpiece (e.g., the first earpiece) is worn and in the state in which another earpiece (e.g., the second earpiece) is not worn (in the state in which the nozzle portion is not blocked but is not worn in the user's ear), the system may cause the call sound to be reproduced through the earpiece, which is in the worn state, and may cause the user's voice to be received through the microphone included in the earpiece, which is in the non-worn state. For example, the system may use the earpiece, which is in the worn state, as a receiver for reception, and may use the earpiece, which is in the non-worn state, as a microphone for transmission.

According to an embodiment, in the state in which the nozzle portion of one earpiece (e.g., the first earpiece) is not blocked and in the state in which another earpiece (e.g., the second earpiece) is not worn (in the state in which the nozzle portion is not blocked but is not worn in the user's ear), the system may cause the user's voice to be received through the microphone included in the earpiece, which is in the non-worn state. For example, the earpiece, which is in the non-worn state, may be used as a microphone for recording. In some embodiments, the system may cause the user's voice to be received through the microphone included in the earpiece, which is in the non-worn state, and may cause a call sound to be reproduced through the speaker (or the receiver) of an external device (e.g., a smart phone) connected (paired) with the earpiece, which is in the non-worn state. For example, the system may use the earpiece, which is in the non-worn state, as a microphone for transmission, and may use the external electronic device as a receiver for reception.

According to an embodiment, in the state in which at least one earpiece is incompletely worn (in the state in which the nozzle portion of the earpiece is not in close contact with the ear canal), the system may provide an information providing function for normal wearing of the earpiece. For example, the system may output an acoustic signal corresponding to information for normal wearing through the speaker of the earpiece, which is incompletely worn. Alternatively, the system may perform control such that the information is transmitted to an external electronic device and an acoustic signal corresponding to the information is output through the speaker of the external electronic device or a display object corresponding to the information is output through a display of the external electronic device.

The system described above with reference to FIG. 11 is an electronic device (e.g., a smart phone) capable of communicating with the first earpiece and the second earpiece and capable of controlling the first earpiece and the second earpiece. In addition, in FIG. 11 described above, the operations of a system (or an electronic device) capable of controlling the first earpiece and the second earpiece have been described, but are not limited thereto. According to an embodiment, one of the first earpiece and the second earpiece may be set as a master device, and the operations described above with reference to FIG. 11 may be performed through the earpiece set as the master device. For example, when the first earpiece is set as the master device, in operation 1110, the first earpiece may determine the state thereof, may receive information about the state of the second earpiece from the second earpiece, and may determine the state of the second earpiece based on the information. In operation 1120, the first earpiece may perform functions depending on the states of the first earpiece and the second earpiece. For example, the first earpiece may directly perform a first function to be performed on the first earpiece among the functions, and may perform control such that information corresponding to a second function to be performed on the second earpiece among the functions is transmitted to the second earpiece such that the second earpiece performs the second function. In some embodiments, without setting the first earpiece and the second earpiece as a master device and a slave device, respectively, one earpiece (e.g., the first earpiece) receives information about the state of the other earpiece (e.g., the second earpiece) from the other earpiece, and may determine the state of the other earpiece based on the received information. In addition, the one earpiece (e.g., the first earpiece) may perform functions depending on the states of the one earpiece and the other earpiece. In this case, the one earpiece, which determines the state of the other earpiece and performs a function depending on the determined state, may be an earpiece first separated from a cradle or an earpiece first worn in the user's ear. Alternatively, the one earpiece may be an earpiece designated based on set information among a plurality of earpieces or an earpiece selected by the user.

As described above, according to an embodiment, a method of detecting wearing of an acoustic device (e.g., the electronic device 101 in FIG. 1 or the acoustic device in FIG. 3) may include: outputting a first signal through a speaker of the acoustic device; receiving a second signal corresponding to the first signal through a first microphone of the acoustic device; outputting a third signal through the speaker when a magnitude of a first frequency band component of the second signal is greater than a first value; receiving a fourth signal corresponding to the third signal through the first microphone; and determining that a nozzle portion of the acoustic device is blocked but the acoustic device is not worn in a user's ear when a magnitude of a second frequency band component of the fourth signal is greater than a second value.

According to an embodiment, the wearing detection method may further include: receiving an external acoustic signal through a second microphone of the acoustic device; and determining an output intensity of the first signal based on an analysis result of the received acoustic signal.

According to an embodiment, the wearing detection method may further include: re-outputting the first signal through the speaker when the magnitude of the first frequency band component of the second signal is equal to or smaller than the first value; re-receiving the second signal corresponding to the re-output first signal through the first microphone; and re-determining whether the magnitude of the first frequency band component of the re-received second signal is greater than the first value.

According to an embodiment, the wearing detection method may further include: re-outputting the first signal through the speaker when the magnitude of a third frequency band component of the fourth signal is equal to or smaller than a third value; re-receiving the second signal corresponding to the re-output first signal through the first microphone; and re-determining whether the magnitude of the first frequency band component of the re-received second signal is greater than the first value.

According to an embodiment, the wearing detection method may further include: determining that the nozzle portion is in a normally worn state in which the nozzle portion is inserted into the user's ear and is in close contact with an ear canal when the magnitude of a third frequency band component of the fourth signal is greater than a third value; and determining that the nozzle portion is in the incompletely worn state in which the nozzle portion is inserted into the user's ear but is not in close contact with the ear canal when the magnitude of the third frequency band component of the fourth signal is equal to or smaller than the third value.

According to an embodiment, the wearing detection method may further include: acquiring a sensing value depending on presence or absence of an object approaching or located in a vicinity of the acoustic device through a proximity sensor included in the acoustic device; and determining a state of the acoustic device based on an analysis result of the fourth signal and an analysis result of the sensing value.

According to an embodiment, the wearing detection method may further include: acquiring a magnetic value depending on presence or absence of a magnetic body approaching or located in a vicinity of the acoustic device through a Hall sensor included in the acoustic device; determining whether the acoustic device is fastened to a cradle including the magnetic body based on an analysis result of the magnetic value; and controlling the speaker not to output the first signal when the acoustic device is fastened to the cradle.

According to an embodiment, the wearing detection method may further include: outputting an acoustic signal corresponding to information about a state of the acoustic device through the speaker; or transmitting the information to an external electronic device through a communication circuit included in the acoustic device.

According to an embodiment, the wearing detection method may further include: receiving first information about a state of another acoustic device from the another acoustic device through a communication circuit included in the acoustic device; determining a state of the another acoustic device based on an analysis result of the first information; selecting a first function to be performed by the acoustic device and a second function to be performed by the another acoustic device based on the state of the acoustic device and the state of the another acoustic device; performing the first function; and transmitting second information corresponding to the second function to the another acoustic device through the communication circuit.

Figure 12:
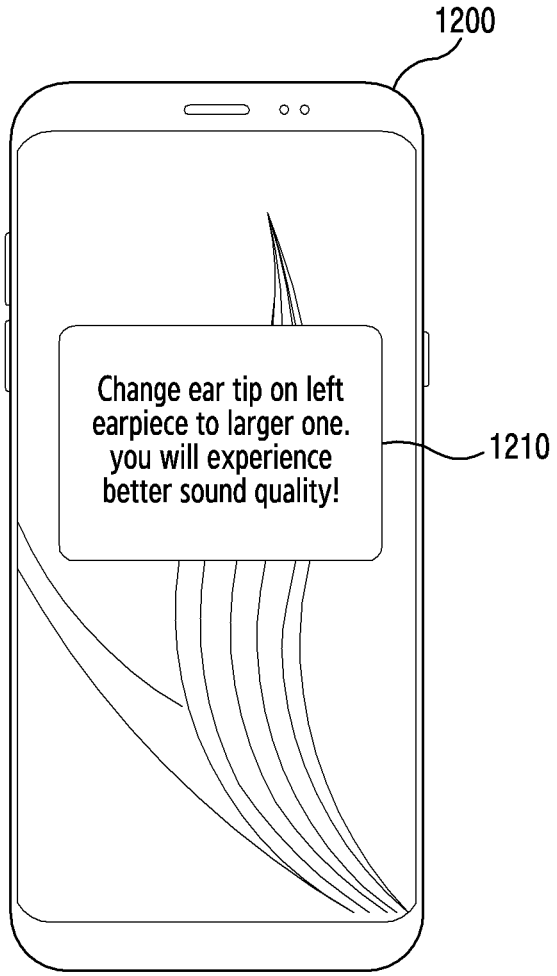
FIG. 12 illustrates how to provide information depending on the worn state of an acoustic device according to an embodiment of the disclosure.

FIG. 12 is a view for describing how to provide information depending on the worn state of an acoustic device according to an embodiment of the disclosure.

Referring to FIG. 12, an acoustic device (e.g., the electronic device 101 of FIG. 1 or the acoustic device of FIG. 3) may provide information according to a state of the acoustic device. For example, the acoustic device may provide a user with information about a non-worn state, an incompletely worn state, or a worn state of the acoustic device. For example, the acoustic device may output an acoustic signal corresponding to the information through a speaker (e.g., the sound output device 155 in FIG. 1 or the speaker 330 in FIG. 3) included therein. As another example, the acoustic device may transmit the information to an external electronic device 1200 connected in communication to the acoustic device. At this time, the external electronic device 1200, which has received the information, may output an acoustic signal corresponding to the information through a speaker of the external electronic device 1200 or may output a display object 1210 corresponding to the information through a display of the external electronic device 1200.

According to an embodiment, the information may include information indicating the state of the acoustic device or information for normally wearing the acoustic device when the acoustic device is incompletely worn. The information for normally wearing the acoustic device may include at least one of, for example, information for guiding re-wearing of the acoustic device, which is incompletely worn, or information for guiding replacement of an accessory (e.g., an ear tip) of the acoustic device.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to an embodiment, by determining the state of an acoustic device more accurately, it is possible to solve a problem of erroneous recognition of wearing.

In addition, an embodiment may be advantageous in terms of design and circuit mounting of an acoustic device in that some components, which have been required to perform a specific function of the acoustic device, are not needed.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An acoustic device comprising:

a housing;

a nozzle portion protruding outwards from one surface of the housing;

a speaker hole penetrating the housing from an inner surface of the housing to a protruding end surface of the nozzle portion;

a first microphone hole penetrating the housing from the inner surface of the housing to the protruding end surface of the nozzle portion;

a speaker disposed inside the housing and connected to the speaker hole;

a first microphone disposed inside the housing and connected to the first microphone hole; and at least one processor disposed inside the housing and electrically connected to the speaker and the first microphone, wherein the at least one processor is configured to:

output a first signal through the speaker, receive a second signal corresponding to the first signal through the first microphone, output a third signal through the speaker when a magnitude of a first frequency band component of the second signal is greater than a first value, receive a fourth signal corresponding to the third signal through the first microphone, and determine that the protruding end surface of the nozzle portion is blocked and the acoustic device is not worn in a user's ear when a magnitude of a second frequency band component of the fourth signal is greater than a second value.

2. The acoustic device of claim 1, wherein the first signal comprises a signal in a non-audible band lower than the first frequency, and wherein the third signal comprises a signal in a high-frequency band higher than the second frequency.

3. The acoustic device of claim 2, wherein the third signal further comprises a signal in a low-frequency band lower than the third frequency.

4. The acoustic device of claim 1, further comprising:

a second microphone hole penetrating a portion of the one surface of the housing in which the nozzle portion is not disposed; and a second microphone disposed inside the housing, connected to the second microphone hole, and electrically connected to the at least one processor, wherein the at least one processor is further configured to:

receive an external acoustic signal through the second microphone, and determine an output intensity of the first signal based on an analysis result of the received acoustic signal.

5. The acoustic device of claim 1, wherein, when the magnitude of the first frequency band component of the second signal is equal to or less than the first value, the at least one processor is further configured to:

re-output the first signal through the speaker, re-receive the second signal corresponding to the re-output first signal through the first microphone, and re-determine whether the magnitude of the first frequency band component of the re-received second signal is greater than the first value.

6. The acoustic device of claim 1, wherein, when the magnitude of a third frequency band component of the fourth signal is equal to or less than a third value, the at least one processor is further configured to:

re-output the first signal through the speaker, re-receive the second signal corresponding to the re-output first signal through the first microphone, and re-determine whether the magnitude of the first frequency band component of the re-received second signal is greater than the first value.

7. The acoustic device of claim 1, wherein the at least one processor is further configured to:

determine that the nozzle portion is in a normally worn state in which the nozzle portion is inserted into the user's ear and is in close contact with an ear canal when the magnitude of a third frequency band component of the fourth signal is greater than a third value, and determine that the nozzle portion is inserted into the user's ear and is not in close contact with the ear canal when the magnitude of the third frequency band component of the fourth signal is equal to or smaller than the third value.

8. The acoustic device of claim 1, further comprising:

a proximity sensor, wherein the at least one processor is further configured to:

acquire a sensing value depending on presence or absence of an object approaching or located in a vicinity of the acoustic device through the proximity sensor, and determine a state of the acoustic device based on an analysis result of the fourth signal and an analysis result of the sensing value.

9. The acoustic device of claim 1, further comprising:

a Hall sensor, wherein the at least one processor is further configured to:

acquire a magnetic value depending on presence or absence of a magnetic body approaching or located in a vicinity of the acoustic device through the Hall sensor, determine whether the acoustic device is fastened to the cradle including the magnetic body based on an analysis result of the magnetic value, and control the speaker to not output the first signal when the acoustic device is fastened to the cradle.

10. The acoustic device of claim 1, further comprising:

a communication circuit configured to communicate with an external electronic device, wherein the at least one processor is further configured to:

output an acoustic signal corresponding to information about a state of the acoustic device through the speaker, or transmit the information to the external electronic device through the communication circuit.

11. The acoustic device of claim 1, further comprising:

a communication circuit configured to communicate with another external electronic device, wherein the at least one processor is further configured to:

receive first information about a state of the other acoustic device from the other acoustic device through the communication circuit, determine a state of the other acoustic device based on an analysis result of the first information, select a first function to be performed by the acoustic device and a second function to be performed by the other acoustic device based on the state of the acoustic device and the state of the other acoustic device, perform the first function, and transmit second information corresponding to the second function to the other acoustic device through the communication circuit.

12. A method of detecting wearing of an acoustic device, the method comprising:

outputting a first signal through a speaker of the acoustic device;

receiving a second signal corresponding to the first signal through a first microphone of the acoustic device;

outputting a third signal through the speaker when a magnitude of a first frequency band component of the second signal is greater than a first value;

receiving a fourth signal corresponding to the third signal through the first microphone; and determining that a nozzle portion of the acoustic device is blocked and the acoustic device is not worn in a user's ear when a magnitude of a second frequency band component of the fourth signal is greater than a second value.

13. The method of claim 12, further comprising:

receiving an external acoustic signal through a second microphone of the acoustic device; and determining an output intensity of the first signal based on an analysis result of the received acoustic signal.

14. The method of claim 12, further comprising:

re-outputting the first signal through the speaker when the magnitude of the first frequency band component of the second signal is equal to or smaller than the first value;

re-receiving the second signal corresponding to the re-output first signal through the first microphone; and re-determining whether the magnitude of the first frequency band component of the re-received second signal is greater than the first value.

15. The method of claim 12, further comprising:

re-outputting the first signal through the speaker when the magnitude of a third frequency band component of the fourth signal is equal to or smaller than a third value;

re-receiving the second signal corresponding to the re-output first signal through the first microphone; and re-determining whether the magnitude of the first frequency band component of the re-received second signal is greater than the first value.

16. The method of claim 12, further comprising:

determining that the nozzle portion is in a normally worn state in which the nozzle portion is inserted into the user's ear and is in close contact with an ear canal when the magnitude of a third frequency band component of the fourth signal is greater than a third value; and determining that the nozzle portion is in an incomplete worn state in which the nozzle portion is inserted into the user's ear and is not in close contact with the ear canal when the magnitude of the third frequency band component of the fourth signal is equal to or smaller than the third value.

17. The method of claim 12, further comprising:

acquiring a sensing value depending on presence or absence of an object approaching or located in a vicinity of the acoustic device through a proximity sensor included in the acoustic device; and determining a state of the acoustic device based on an analysis result of the fourth signal and an analysis result of the sensing value.

18. The method of claim 12, further comprising:

acquiring a magnetic value depending on presence or absence of a magnetic body approaching or located in a vicinity of the acoustic device through a Hall sensor included in the acoustic device;

determining whether the acoustic device is fastened to a cradle including the magnetic body based on an analysis result of the magnetic value; and controlling the speaker to not output the first signal when the acoustic device is fastened to the cradle.

19. The method of claim 12, further comprising:

outputting an acoustic signal corresponding to information about a state of the acoustic device through the speaker; or transmitting the information to an external electronic device through a communication circuit included in the acoustic device.

20. The method of claim 12, further comprising:

receiving first information about a state of another acoustic device from the other acoustic device through a communication circuit included in the acoustic device;

determining a state of the other acoustic device based on an analysis result of the first information;

selecting a first function to be performed by the acoustic device and a second function to be performed by the other acoustic device based on the state of the acoustic device and the state of the other acoustic device;

performing the first function; and transmitting second information corresponding to the second function to the other acoustic device through the communication circuit.

* * * * *